US012410813B2

(12) United States Patent
Conrad

(10) Patent No.: US 12,410,813 B2
(45) Date of Patent: Sep. 9, 2025

(54) HOUSEHOLD APPLIANCE HAVING AN IMPROVED FAN AND MOTOR ASSEMBLY AND FAN AND MOTOR ASSEMBLY FOR SAME

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 0 days.

(21) Appl. No.: 17/911,226

(22) PCT Filed: Mar. 31, 2021

(86) PCT No.: PCT/CA2021/050434
§ 371 (c)(1),
(2) Date: Sep. 13, 2022

(87) PCT Pub. No.: WO2021/195773
PCT Pub. Date: Oct. 7, 2021

(65) Prior Publication Data

US 2023/0098664 A1 Mar. 30, 2023

Related U.S. Application Data

(63) Continuation-in-part of application No. 17/094,330, filed on Nov. 10, 2020, now Pat. No. 11,517,091,
(Continued)

(51) Int. Cl.
*F04D 29/46* (2006.01)
*A45D 20/00* (2006.01)
(Continued)

(52) U.S. Cl.
CPC ..... *F04D 29/462* (2013.01); *A45D 20/00* (2013.01); *A47L 11/4002* (2013.01); *F04D 25/06* (2013.01)

(58) Field of Classification Search
CPC ..... F04D 17/165; F04D 25/06; F04D 27/002; F04D 29/442; F04D 29/46; F04D 29/462; F04D 29/464; A45D 20/00; A47L 11/4002
See application file for complete search history.

(56) References Cited

U.S. PATENT DOCUMENTS 5,255,411 A 10/1993 Da Costa
5,267,371 A 12/1993 Soler et al.
(Continued)

FOREIGN PATENT DOCUMENTS

CA 2275675 A1 12/1999
CA 2288544 A1 5/2000
(Continued)

OTHER PUBLICATIONS

Machine translation of JP-2003083295-A to Hirose et al, published Mar. 19, 2003 (Year: 2003).*
(Continued)

*Primary Examiner* — David E Sosnowski
*Assistant Examiner* — Jason G Davis
(74) *Attorney, Agent, or Firm* — Philip C. Mendes da Costa; SMART & BIGGAR LP

(57) ABSTRACT

A household appliance has an air flow path extending from an air inlet to an air outlet with a fan and motor assembly in the air flow path. The fan and motor assembly comprises a motor drivingly connected to a rotating fan blade subassembly. The fan and motor assembly is adjustable between a first configuration in which the rotating fan blade subassembly provides a first level of air flow and a first level of suction
(Continued)

and a second configuration in which the rotating fan blade subassembly provides a second level of air flow and a second level of suction wherein the first level of air flow is higher than the second level of air flow and the second level of suction is higher than the first level of suction.

18 Claims, 25 Drawing Sheets

Related U.S. Application Data which is a continuation-in-part of application No. 16/944,388, filed on Jul. 31, 2020, now Pat. No. 11,457,713, which is a continuation-in-part of application No. 16/938,057, filed on Jul. 24, 2020, now Pat. No. 11,425,979, said application No. PCT/CA2021/050434 is a continuation-in-part of application No. 16/938,057, filed on Jul. 24, 2020, now Pat. No. 11,425,979, and a continuation-in-part of application No. 16/837,996, filed on Apr. 1, 2020, now Pat. No. 11,425,980, said application No. 16/938,057 is a continuation-in-part of application No. 16/837,996, filed on Apr. 1, 2020, now Pat. No. 11,425,980.

(60) Provisional application No. 63/062,600, filed on Aug. 7, 2020, provisional application No. 63/044,788, filed on Jun. 26, 2020, provisional application No. 63/035,282, filed on Jun. 5, 2020, provisional application No. 63/027,006, filed on May 19, 2020.

(51) Int. Cl.
*A47L 11/40* (2006.01)
*F04D 25/06* (2006.01)

(56) References Cited

U.S. PATENT DOCUMENTS 5,358,290 A 10/1994 Fleet et al.
5,921,748 A * 7/1999 Frater ..... F04D 29/167 415/196
5,974,625 A 11/1999 Garner
6,042,333 A * 3/2000 Day ..... F04D 29/36 416/185
6,098,244 A 8/2000 Conrad et al.
6,099,661 A 8/2000 Conrad
6,101,672 A 8/2000 Conrad et al.
6,123,779 A 9/2000 Conrad et al.
6,129,775 A 10/2000 Conrad et al.
6,135,708 A 10/2000 Conrad et al.
6,168,716 B1 1/2001 Conrad et al.
6,170,119 B1 1/2001 Conrad et al.
6,173,474 B1 1/2001 Conrad
6,174,127 B1 1/2001 Conrad et al.
6,183,641 B1 2/2001 Conrad et al.
6,224,325 B1 5/2001 Conrad et al.
6,231,645 B1 5/2001 Conrad et al.
6,238,177 B1 5/2001 Conrad et al.
6,243,917 B1 6/2001 Conrad
6,251,296 B1 6/2001 Conrad et al.
6,261,052 B1 7/2001 Conrad et al.
6,261,379 B1 7/2001 Conrad et al.
6,280,143 B1 8/2001 Parker et al.
6,307,358 B1 10/2001 Conrad
6,312,594 B1 11/2001 Conrad et al.
6,328,527 B1 12/2001 Conrad et al.
6,334,234 B1 1/2002 Conrad et al.
6,344,064 B1 2/2002 Conrad
6,440,197 B1 8/2002 Conrad et al.
6,457,205 B1 10/2002 Conrad
6,533,834 B2 3/2003 Conrad et al.
6,599,340 B2 7/2003 Conrad et al.
6,782,585 B1 8/2004 Conrad et al.
7,329,294 B2 2/2008 Conrad
7,334,987 B2 * 2/2008 Oh ..... F04D 29/444 415/211.1
7,740,675 B2 6/2010 Conrad
7,749,293 B2 7/2010 Conrad
7,776,120 B2 8/2010 Conrad
7,803,207 B2 9/2010 Conrad
7,811,345 B2 10/2010 Conrad
7,867,308 B2 1/2011 Conrad
7,941,895 B2 5/2011 Conrad
8,127,398 B2 3/2012 Conrad
8,146,201 B2 4/2012 Conrad
8,151,407 B2 4/2012 Conrad
8,176,596 B2 5/2012 Conrad
8,192,515 B2 6/2012 Conrad
8,292,979 B2 10/2012 Conrad
8,296,900 B2 10/2012 Conrad
8,349,428 B2 1/2013 Conrad
8,370,993 B2 2/2013 Conrad
8,375,508 B2 2/2013 Conrad
8,448,291 B2 5/2013 Conrad
8,479,358 B2 7/2013 Conrad
8,486,170 B2 7/2013 Conrad et al.
8,510,907 B2 8/2013 Conrad
8,533,904 B2 9/2013 Conrad
8,561,257 B2 10/2013 Conrad
8,567,005 B2 10/2013 Conrad
8,578,550 B2 11/2013 Conrad
8,578,553 B2 11/2013 Conrad
8,590,102 B2 11/2013 Conrad
8,607,407 B2 12/2013 Conrad
8,621,709 B2 1/2014 Conrad
8,640,304 B2 2/2014 Conrad
8,646,147 B2 2/2014 Conrad
8,659,184 B2 2/2014 Conrad
8,677,554 B2 3/2014 Conrad
8,677,558 B2 3/2014 Conrad
8,713,751 B2 5/2014 Conrad
8,813,305 B2 8/2014 Conrad
8,834,209 B2 9/2014 Conrad
8,869,344 B2 10/2014 Conrad
8,869,345 B2 10/2014 Conrad
8,869,348 B2 10/2014 Conrad
8,875,340 B2 11/2014 Conrad
8,875,342 B2 11/2014 Conrad
9,005,324 B2 4/2015 Smith
9,027,198 B2 5/2015 Conrad
9,027,203 B2 5/2015 Conrad et al.
9,066,642 B2 6/2015 Conrad
9,119,513 B2 9/2015 Conrad
9,161,666 B2 10/2015 Conrad
9,161,669 B2 10/2015 Conrad
9,167,944 B2 10/2015 Conrad
9,204,769 B2 12/2015 Conrad
9,204,773 B2 12/2015 Conrad
9,215,960 B2 12/2015 Conrad
9,226,633 B2 1/2016 Conrad et al.
9,227,151 B2 1/2016 Conrad
9,227,201 B2 1/2016 Conrad
9,232,881 B2 1/2016 Conrad
9,238,235 B2 1/2016 Conrad
9,295,995 B2 3/2016 Conrad
9,314,138 B2 4/2016 Conrad
9,314,139 B2 4/2016 Conrad et al.
9,320,401 B2 4/2016 Conrad
9,326,652 B2 5/2016 Conrad
9,364,127 B2 6/2016 Conrad
9,427,122 B2 8/2016 Conrad et al.
9,427,126 B2 8/2016 Conrad
9,433,332 B2 9/2016 Conrad
9,451,852 B2 9/2016 Conrad
9,451,855 B2 9/2016 Conrad
9,456,721 B2 10/2016 Conrad
9,492,045 B2 11/2016 Conrad
9,526,394 B2 12/2016 Conrad
9,572,463 B2 2/2017 Conrad
9,591,952 B2 3/2017 Conrad
9,591,958 B2 3/2017 Conrad

(56) References Cited

U.S. PATENT DOCUMENTS

| | | | | |
|---|---|---|---|---|
| 9,717,385 | B2 | 8/2017 | Liter | |
| 9,775,484 | B2 | 10/2017 | Conrad | |
| 9,801,513 | B2 | 10/2017 | Conrad et al. | |
| 9,820,621 | B2 | 11/2017 | Conrad et al. | |
| 9,962,048 | B2 * | 5/2018 | Conrad | A47L 9/2857 |
| 10,076,183 | B2 | 9/2018 | Conrad et al. | |
| 10,145,386 | B2 * | 12/2018 | Oh | F04D 29/441 |
| 10,149,587 | B2 | 12/2018 | Conrad et al. | |
| 10,159,393 | B2 | 12/2018 | Conrad | |
| 10,201,260 | B2 | 2/2019 | Conrad et al. | |
| 10,214,349 | B2 | 2/2019 | Conrad | |
| 10,251,519 | B2 | 4/2019 | Conrad | |
| 10,357,136 | B2 | 7/2019 | Conrad | |
| 10,517,448 | B2 | 12/2019 | Shiozawa et al. | |
| 10,537,216 | B2 | 1/2020 | Conrad | |
| 10,537,219 | B2 | 1/2020 | Conrad et al. | |
| 10,568,477 | B2 | 2/2020 | Conrad | |
| 10,575,693 | B2 | 3/2020 | Conrad | |
| 10,667,663 | B2 | 6/2020 | Conrad | |
| 10,687,679 | B2 | 6/2020 | Conrad et al. | |
| 10,702,116 | B2 | 7/2020 | Conrad et al. | |
| 10,729,294 | B2 | 8/2020 | Conrad et al. | |
| 10,791,890 | B2 | 10/2020 | Conrad | |
| 10,791,896 | B2 | 10/2020 | Conrad | |
| 10,888,205 | B2 | 1/2021 | Conrad et al. | |
| 10,932,634 | B2 | 3/2021 | Conrad | |
| 10,959,588 | B2 | 3/2021 | Conrad et al. | |
| 11,013,378 | B2 | 5/2021 | Conrad | |
| 11,108,254 | B2 | 8/2021 | Conrad | |
| 11,135,602 | B2 | 10/2021 | Conrad | |
| 11,154,169 | B2 | 10/2021 | Conrad | |
| 11,198,085 | B2 | 12/2021 | Conrad et al. | |
| 11,213,179 | B2 | 1/2022 | Conrad | |
| 11,246,462 | B2 | 2/2022 | Conrad | |
| 11,285,495 | B2 | 3/2022 | Conrad | |
| 11,318,482 | B2 | 5/2022 | Conrad | |
| 11,478,116 | B2 | 10/2022 | Conrad | |
| 11,478,117 | B2 | 10/2022 | Conrad et al. | |
| 11,529,034 | B2 | 12/2022 | Conrad | |
| 11,534,041 | B2 | 12/2022 | Conrad | |
| 11,534,043 | B2 | 12/2022 | Conrad | |
| 11,534,702 | B2 | 12/2022 | Conrad | |
| 11,547,258 | B2 | 1/2023 | Conrad | |
| 11,571,097 | B2 | 2/2023 | Conrad | |
| 11,612,290 | B2 | 3/2023 | Conrad | |
| 11,737,625 | B2 | 8/2023 | Conrad | |
| 11,745,131 | B2 | 9/2023 | Conrad | |
| 11,793,374 | B2 | 10/2023 | Conrad | |
| 11,839,343 | B2 | 12/2023 | Conrad et al. | |
| 11,841,024 | B2 | 12/2023 | Conrad | |
| 11,857,052 | B2 * | 1/2024 | Conrad | B01D 50/20 |
| 11,857,142 | B2 | 1/2024 | Conrad | |
| 11,950,745 | B2 | 4/2024 | Conrad et al. | |
| 2001/0027587 | A1 | 10/2001 | Conrad et al. | |
| 2002/0162188 | A1 | 11/2002 | Harmen | |
| 2003/0201754 | A1 | 10/2003 | Conrad | |
| 2004/0216266 | A1 | 11/2004 | Conrad | |
| 2006/0196004 | A1 | 9/2006 | Conrad | |
| 2008/0172992 | A1 | 7/2008 | Conrad | |
| 2008/0178416 | A1 | 7/2008 | Conrad | |
| 2008/0178418 | A1 | 7/2008 | Conrad | |
| 2008/0179133 | A1 | 7/2008 | Conrad | |
| 2008/0196366 | A1 | 8/2008 | Conrad | |
| 2008/0216281 | A1 | 9/2008 | Conrad | |
| 2010/0175217 | A1 | 7/2010 | Conrad | |
| 2010/0229323 | A1 | 9/2010 | Conrad | |
| 2010/0229325 | A1 | 9/2010 | Conrad | |
| 2010/0229326 | A1 | 9/2010 | Conrad | |
| 2010/0229334 | A1 | 9/2010 | Conrad | |
| 2010/0229335 | A1 | 9/2010 | Conrad | |
| 2010/0251507 | A1 | 10/2010 | Conrad | |
| 2011/0219567 | A1 | 9/2011 | Conrad | |
| 2011/0219579 | A1 | 9/2011 | Conrad | |
| 2012/0186036 | A1 * | 7/2012 | Kegg | A47L 5/22 415/191 |
| 2013/0171013 | A1 | 7/2013 | Jang et al. | |
| 2014/0086725 | A1 | 3/2014 | Shi | |
| 2014/0237768 | A1 | 8/2014 | Conrad | |
| 2017/0314575 | A1 * | 11/2017 | Oh | F04D 29/444 |
| 2020/0305671 | A1 | 10/2020 | Conrad | |
| 2021/0228032 | A1 | 7/2021 | Conrad | |
| 2021/0330157 | A1 | 10/2021 | Conrad | |
| 2021/0386258 | A1 | 12/2021 | Conrad | |
| 2022/0142440 | A1 | 5/2022 | Conrad | |
| 2022/0151446 | A1 | 5/2022 | Conrad et al. | |
| 2023/0098664 | A1 | 3/2023 | Conrad | |
| 2023/0263350 | A1 | 8/2023 | Conrad et al. | |
| 2023/0348169 | A1 | 11/2023 | Conrad | |
| 2024/0016351 | A1 | 1/2024 | Conrad | |
| 2024/0138634 | A1 | 5/2024 | Conrad | |
| 2024/0180373 | A1 | 6/2024 | Conrad et al. | |
| 2024/0358212 | A1 | 10/2024 | Conrad | |

FOREIGN PATENT DOCUMENTS

| | | | | |
|---|---|---|---|---|
| CA | 2258416 | A1 | 7/2000 | |
| CA | 2258419 | A1 | 7/2000 | |
| CA | 2258421 | A1 | 7/2000 | |
| CA | 2258422 | A1 | 7/2000 | |
| CA | 2258423 | A1 | 7/2000 | |
| CA | 2258426 | A1 | 7/2000 | |
| CA | 2330801 | A1 | 7/2001 | |
| CA | 2338193 | A1 | 7/2002 | |
| CA | 2339514 | A1 | 9/2002 | |
| CA | 2342673 | A1 | 9/2002 | |
| CA | 2342993 | A1 | 9/2002 | |
| CA | 2658014 | A1 | 9/2010 | |
| CA | 2658022 | A1 | 9/2010 | |
| CA | 2658160 | A1 | 9/2010 | |
| CA | 2658366 | A1 | 9/2010 | |
| CA | 2658397 | A1 | 9/2010 | |
| CA | 2658497 | A1 | 9/2010 | |
| CA | 2658643 | A1 | 9/2010 | |
| CA | 2658644 | A1 | 9/2010 | |
| JP | 2003083295 | A * | 3/2003 | F04D 29/462 |
| WO | 0010718 | A1 | 3/2000 | |

OTHER PUBLICATIONS

International Search Report and Written Opinion, received in connection to international patent application No. PCT/CA2021/050434, mailed on.

U.S. Appl. No. 09/343,479, filed Jun. 30, 1999.

* cited by examiner

HOUSEHOLD APPLIANCE HAVING AN IMPROVED FAN AND MOTOR ASSEMBLY AND FAN AND MOTOR ASSEMBLY FOR SAME

CROSS-REFERENCE TO RELATED APPLICATIONS

This application is a national phase entry of International Patent Application No. PCT/CA2021/050434, filed on Mar. 31, 2021, which itself Is:

(1) a continuation-in-part of co-pending U.S. patent application Ser. No. 17/094,330, filed on Nov. 10, 2020, which itself a. is a continuation-in-part of U.S. patent application Ser. No. 16/944,388, filed on Jul. 31, 2020, which itself is a continuation-in-part of U.S. patent application Ser. No. 16/938,057, filed on Jul. 24, 2020, which itself is a continuation-in-part of U.S. patent application Ser. No. 16/837,996, filed on Apr. 1, 2020 and issued as U.S. Pat. No. 11,425,980 on Aug. 30, 2022, wherein said U.S. patent application Ser. Nos. 16/938,057 and 16/944,388 each also claim the benefit of U.S. Provisional Patent Application No. 63/027,006, filed on May 19, 2020; U.S. Provisional Patent Application No. 63/035,282, filed on Jun. 5, 2020; and U.S. Provisional Patent Application No. 63/044,788, filed on Jun. 26, 2020 entitled HAIR DRYER, and b. claims the benefit of U.S. Provisional Patent Application No. 63/027,006, filed on May 19, 2020; U.S. Provisional Patent Application No. 63/035,282, filed on Jun. 5, 2020; and U.S. Provisional Patent Application No. 63/044,788, filed on Jun. 26, 2020 entitled HAIR DRYER, and this application is also:

(2) continuation-in-part of U.S. patent application Ser. No. 16/938,057, filed on Jul. 24, 2020, which itself is a continuation-in-part of U.S. patent application Ser. No. 16/837,996, filed on Apr. 1, 2020 and issued as patent Ser. No. 11/425,980 on Aug. 30, 2022, and said U.S. patent application Ser. No. 16/938,057 also claims the benefit of U.S. Provisional Patent Application No. 63/027,006, filed on May 19, 2020; U.S. Provisional Patent Application No. 63/035,282, filed on Jun. 5, 2020; and U.S. Provisional Patent Application No. 63/044,788, filed on Jun. 26, 2020 entitled HAIR DRYER;

(3) Continuation-in-part of U.S. patent application Ser. No. 16/837,996, filed on Apr. 1, 2020 and issued as U.S. Pat. No. 11,425,980 on Aug. 30, 2022;

And said international Patent application No. PCT/CA2021/050434:

(4) Claims benefit of priority to U.S. patent application Ser. No. 16/837,996, filed on Apr. 1, 2020 and issued as U.S. Pat. No. 11,425,980 on Aug. 30, 2022;

(5) Claims benefit of priority to U.S. Provisional Patent Application No. 63/035,282, filed on Jun. 5, 2020;

(6) Claims benefit of priority to U.S. patent application Ser. No. 16/938,057, filed on Jul. 24, 2020;

(7) Claims benefit of priority to U.S. Provisional Patent Application No. 63/062,600, filed on Aug. 7, 2020; entitled FAN AND MOTOR ASSEMBLY FOR IMPROVED AIR FLOW; and (8) Claims benefit of priority to U.S. patent application Ser. No. 17/094,330, filed on Nov. 10, 2020;

the contents of each of which are incorporated herein by reference.

FIELD

This disclosure relates generally to fan and motor assemblies such as for use in household appliances and, optionally, portable appliances such as surface cleaning apparatuses, including carpet extractors, room air cleaners and hair dryers.

INTRODUCTION

The following is not an admission that anything discussed below is part of the prior art or part of the common general knowledge of a person skilled in the art.

Various types of fan and motor assemblies for use in portable, lower power appliances are known. For example, fan and motor assemblies are commonly found in products such as corded and cordless vacuum cleaners, carpet extractors, hair dryers, and room air cleaners/purifiers.

Fan and motor assemblies that are commonly found in appliances are generally optimized for one of high suction or high air flow, or are designed such that they provide an acceptable level of both suction and air flow, but are not optimized to provide a maximum level of suction or air flow for the power input to the motor. For example, the fan and motor assembly within a vacuum cleaner may be optimized for high air flow, whereas the fan and motor assembly within a carpet extractor may be optimized for high suction.

It is to be understood that the term air flow refers to the volume of air (e.g., CFM) as it enters (i.e., is sucked/drawn into) an inlet of the appliance.

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

Portable appliances typically use a small relatively light weight motor that can produce an air flow of up to, e.g., 80 cfm. For example, a full-sized upright vacuum cleaner may have an air flow of 50-70 or 80 cfm. A stick vacuum cleaner operated by a removable hand vacuum cleaner may have an air flow of 30-40 cfm. A small hand held vacuum cleaner may have an air flow of 10-30 cfm.

As portable appliances are used in domestic residences and may be used in close proximity to a person, e.g., an air cleaner or hair dryer, noise levels produced by a motor and fan assemblies for portable appliances can be an issue.

In one aspect of this disclosure, which may be used by itself or with one or more of the other aspects disclosed herein, there is provided a fan and motor assembly, which may be used with portable appliances, that may be reconfigurable to promote one of suction or air flow, or to balance the suction force of, and air flow across, the fan and motor assembly. For example, a reconfigurable fan and motor assembly may be used within an appliance that is operable as both a vacuum cleaner and a carpet extractor. Specifically, when the appliance is used as a carpet extractor to remove (i.e., suck) water from, for example, carpet, the fan and motor assembly may be configured to promote suction; whereas, when the appliance is used as a vacuum cleaner to remove dust from, for example, a hard surface, the fan and motor assembly may be configured to promote air flow. Similarly, a vacuum cleaner may be operable in a bare floor cleaning mode wherein the fan and motor assembly may be configured to promote air flow and in a carpet cleaning mode wherein the fan and motor assembly may be configured to promote suction.

In other aspects, specific configurations of a motor and fan assembly are provided which result in enhanced characteristics (e.g., higher air flow or higher suction) for a fixed (non-reconfigurable) motor and fan assembly for use in appliances and, in particular, portable appliances.

In accordance with these broad aspects, there is provided a household appliance having an air flow path extending from an air inlet to an air outlet with a fan and motor assembly in the air flow path. The fan and motor assembly comprises a motor drivingly connected to a first rotating fan blade subassembly and a shield. The first rotating fan blade subassembly comprises a plurality of rotatable blades and a plurality of fan blade air channels. The motor has an axis of rotation. The fan and motor assembly is adjustable between a first configuration in which the first rotating fan blade subassembly provides a first level of air flow and a first level of suction and a second configuration in which the first rotating fan blade subassembly provides a second level of air flow and a second level of suction wherein the first level of air flow is higher than the second level of air flow and the second level of suction is higher than the first level of suction.

In any embodiment, the fan and motor assembly may further comprise a vortex finder. The vortex finder may have an outlet that communicates with an inlet of the first rotating fan blade subassembly. The position of the vortex finder to the inlet may be adjustable between a first position in which the fan and motor assembly is in the first configuration and a second position in which the fan and motor assembly is in the second configuration.

In any embodiment, in the second position, the vortex finder may block a portion of an entrance to the plurality of fan blade air channels.

In any embodiment, in the first position, the vortex finder may be axially spaced from the entrance to the plurality of fan blade air channels.

In any embodiment, the fan and motor assembly may further comprise a seal positioned between the first rotating fan blade subassembly and the shield whereby air entering the fan and motor assembly may be inhibited from bypassing the plurality of fan blade air channels.

In any embodiment, the fan and motor assembly may further comprise a first stationary vane subassembly. The first stationary vane subassembly may comprise a plurality of vanes and a plurality of stationary vane air channels. Each of the vanes may have a leading edge and a trailing edge in a direction of rotation of the first rotating fan blade subassembly. The alignment of the plurality of vanes may be adjustable between a first position and a second position. In the second position the leading edge of one vane may be angularly spaced apart from a trailing edge of an adjacent vane in a direction transverse to the axis of rotation of the motor. A plurality of bypass air gaps may be provided within the stationary vane subassembly that extend through the stationary vane air channels along the axis of rotation of the motor.

In any embodiment, in the first position, the leading edge of each vane may be in line with the trailing edge of the adjacent vane along the axis of rotation of the motor.

In any embodiment, the fan and motor assembly may further comprise a first stationary vane subassembly. The first stationary vane subassembly may comprise a first set of vanes, a second set of vanes and a plurality of stationary vane air channels. The stationary vane air channels may have a width in the direction of rotation of the motor. The position of the first set of vanes with respect to the second set of vanes may be adjustable whereby the width of the stationary vane air channels is adjustable.

In any embodiment, the position of the first set of vanes with respect to the second set of vanes may be adjustable between a first position and a second position. In the first position the first set of vanes may be adjacent the second set of vanes and a first number of stationary vane air channels is provided. In the second position, the first set of vanes may be spaced from the second set of vanes and a second number of stationary vane air channels is provided and the second number of stationary vane air channels is greater than the first number of stationary vane air channels.

In any embodiment, the fan and motor assembly may further comprise a first stationary vane subassembly having a first set of vanes and a first plurality of stationary vane air channels and a second stationary vane subassembly having a second set of vanes and a second plurality of stationary vane air channels. The position of the first set of vanes may be adjustable with respect to the position of the second set of vanes.

In any embodiment, the position of the first set of vanes may be adjustable with respect to the position of the second set of vanes between a first position and a second position. In the second position the first set of vanes may be angularly spaced from the second set of vanes in a direction transverse to the axis of rotation of the motor. A plurality of bypass air gaps may be provided within the first and second stationary vane subassemblies that extend through the stationary vane air channels along the axis of rotation of the motor.

In any embodiment, in the first position, the first set of vanes may be aligned with respect to the second set of vanes in a direction transverse to the axis of rotation of the motor whereby bypass of the first stationary vane subassembly and the second stationary vane subassembly is inhibited.

In any embodiment, the fan and motor assembly may further comprise a rotating dome that overlies the first rotating fan blade subassembly.

In any embodiment, the first rotating fan blade subassembly may have a first end providing an inlet to the first rotating fan blade subassembly and an axially spaced apart second end. The plurality of fan blade air channels may have channel outlets that are provided in an end wall of the second end.

In any embodiment, the first rotating fan blade subassembly may have an end spaced from and facing the shield and a gap between the end and the shield may be variable.

In any embodiment, a pitch of the plurality of rotatable blades may be adjustable.

In any embodiment, the fan and motor assembly may further comprise a vortex finder and a diameter of the vortex finder may be adjustable.

In any embodiment, the fan and motor assembly may further comprise a first stationary vane subassembly having a first set of vanes and a first plurality of stationary vane air channels and a pitch of the plurality of the vanes may be adjustable.

In any embodiment, the household appliance may be a vacuum cleaner, an extractor or a hair dryer.

In accordance with these broad aspects, there is also provided a household appliance having an air flow path extending from an air inlet to an air outlet with a fan and motor assembly in the air flow path. The fan and motor assembly comprising a motor drivingly connected to a first rotating fan blade subassembly and a second rotating fan blade subassembly. The first rotating fan blade subassembly provides a first level of air flow and a first level of suction and the second rotating fan blade subassembly provides a second level of air flow and a second level of suction. The first level of air flow is higher than the second level of air flow and the second level of suction is higher than the first level of suction. The fan and motor assembly is adjustable to vary an amount of air entering the fan and motor assembly that is directed to each of the first and second rotating fan blade subassemblies.

In any embodiment, in a first configuration, at least a majority of the air entering the fan and motor assembly may be directed to the first rotating fan blade subassembly and, in a second configuration, at least a majority of the air may be directed to the second rotating fan blade subassembly.

In any embodiment, in a first configuration, at least a majority of the air entering the fan and motor assembly may be directed to the first rotating fan blade subassembly and then subsequently through the second rotating fan blade subassembly.

In any embodiment, in a first configuration, essentially all of the air entering the fan and motor assembly may be directed to the first rotating fan blade subassembly and, in a second configuration, essentially all of the air may be directed to the second rotating fan blade subassembly.

In any embodiment, in a first configuration, essentially all of the air entering the fan and motor assembly may be directed to the first rotating fan blade subassembly and then subsequently through the second rotating fan blade subassembly.

In any embodiment, in a first configuration, the air entering the fan and motor assembly may flow in series through the first rotating fan blade subassembly and the second rotating fan blade subassembly and, in a second configuration, the air entering the fan and motor assembly may flow through only one of the first rotating fan blade subassembly and the second rotating fan blade subassembly.

In any embodiment, in the second configuration, essentially all of the air may be directed to the second rotating fan blade subassembly.

In any embodiment, the fan and motor assembly may further comprise a vortex finder. Each of the first and second rotating fan blade subassemblies may have an inlet. The position of the vortex finder with respect to the first and second rotating fan blade assemblies may be adjustable to vary the amount of air entering the fan and motor assembly that is directed to each of the first and second rotating fan blade subassemblies.

In any embodiment, the vortex finder may be adjustable between a first position in which the vortex finder directs at least a majority of the air entering the fan and motor assembly to the first rotating fan blade subassembly and a second position in which the vortex finder directs at least a majority of the air entering the fan and motor assembly to the first rotating fan blade subassembly.

In any embodiment, the fan and motor assembly may further comprise a vortex finder and a diameter of the vortex finder may be adjustable.

In any embodiment, the fan and motor assembly may further comprise a vortex finder. The vortex finder may have an outlet that communicates with an inlet of the first rotating fan blade subassembly. The position of the vortex finder to the inlet may be adjustable between a first configuration in which the first rotating fan blade subassembly provides the first level of air flow and the first level of suction and a third configuration in which the first rotating fan blade subassembly provides a third level of air flow and a third level of suction wherein the first level of air flow is higher than the third level of air flow and the third level of suction is higher than the first level of suction.

In any embodiment, the first rotating fan blade subassembly may have a first plurality of rotatable blades, the second rotating fan blade subassembly may have a second plurality of rotatable blades and a pitch of at least one of the first and second plurality of rotatable blades may be adjustable.

In any embodiment, the pitch of each of the first and second plurality of rotatable blades may be adjustable.

In any embodiment, the fan and motor assembly may further comprise a first stationary vane subassembly having a first set of vanes and a first plurality of stationary vane air channels and a pitch of the plurality of the vanes may be adjustable.

In any embodiment, the household appliance may be a vacuum cleaner, an extractor or a hair dryer.

It will be appreciated by a person skilled in the art that an apparatus or method disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1A:
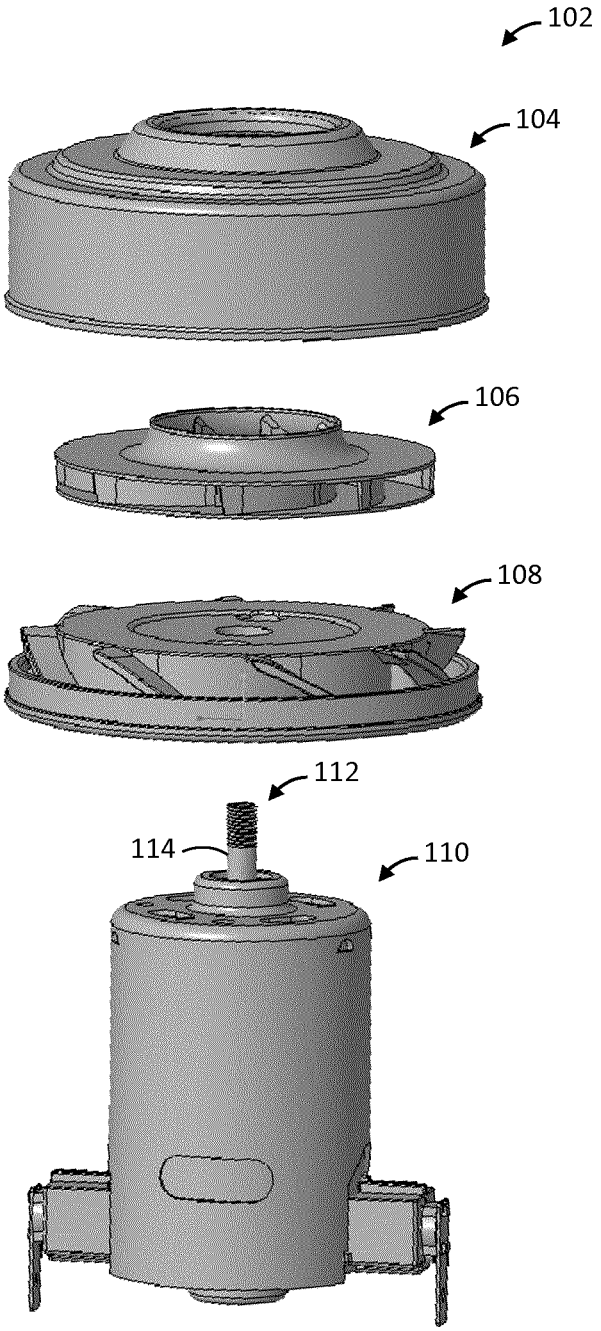
FIG. 1A is an exploded view of a fan and motor assembly.

The drawings included herewith are for illustrating various examples of articles, methods, and apparatuses of the teaching of the present specification and are not intended to limit the scope of what is taught in any way.

DESCRIPTION OF VARIOUS EMBODIMENTS

Various apparatuses will be described below to provide an example of an embodiment of each claimed invention. No embodiment described below limits any claimed invention and any claimed invention may cover apparatuses that differ from those described below. The claimed inventions are not limited to apparatuses having all of the features of any one apparatus described below or to features common to multiple or all of the apparatuses described below. It is possible that an apparatus described below is not an embodiment of any claimed invention. Any invention disclosed in an apparatus described below that is not claimed in this document may be the subject matter of another protective instrument, for example, a continuing patent application, and the applicants, inventors or owners do not intend to abandon, disclaim or dedicate to the public any such invention by its disclosure in this document.

The terms "an embodiment", "embodiment", "embodiments", "the embodiment", "the embodiments", "one or more embodiments", "some embodiments", and "one embodiment" mean "one or more (but not all) embodiments of the present invention(s)," unless expressly specified otherwise.

The terms "including", "comprising", and variations thereof mean "including but not limited to", unless expressly specified otherwise. A listing of items does not imply that any or all of the items are mutually exclusive, unless expressly specified otherwise. The terms "a", "an", and "the" mean "one or more", unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. As used herein, two or more parts are said to be "rigidly coupled", "rigidly connected", "rigidly attached", or "rigidly fastened" where the parts are coupled so as to move as one while maintaining a constant orientation relative to each other. None of the terms "coupled", "connected", "attached", and "fastened" distinguish the manner in which two or more parts are joined together.

Some elements herein may be identified by a part number, which is composed of a base number followed by an alphabetical or subscript-numerical suffix (e.g., 112*a*, or $\mathbf{112}_1$). Multiple elements herein may be identified by part numbers that share a base number in common and that differ by their suffixes (e.g., $\mathbf{112}_1$, $\mathbf{112}_2$, and $\mathbf{112}_3$). All elements with a common base number may be referred to collectively or generically using the base number without a suffix (e.g., 112).

It should be noted that terms of degree such as "substantially", "about", and "approximately" as used herein mean a reasonable amount of deviation of the modified term such that the end result is not significantly changed. These terms of degree may also be construed as including a deviation of the modified term, such as by 1%, 2%, 5% or 10%, for example, if this deviation does not negate the meaning of the term it modifies.

Furthermore, the recitation of numerical ranges by endpoints herein includes all numbers and fractions subsumed within that range (e.g., 1 to 5 includes 1, 1.5, 2, 2.75, 3, 3.90, 4, and 5). It is also to be understood that all numbers and fractions thereof are presumed to be modified by the term "about" which means a variation of up to a certain amount of the number to which reference is being made if the end result is not significantly changed, such as 1%, 2%, 5%, or 10%, for example.

General Description of a Fan and Motor Assembly

Appliances 100 are continuously becoming more versatile while the demand for efficiency and effectiveness remains consistent, if not heightened. For example, in terms of versatility, many appliances 100 may be required to operate using suction and high air flow (e.g., surface cleaning apparatus such as a vacuum cleaner for cleaning bare floors and carpet, a combined vacuum cleaner and extractor, hair dryers, etc.) and also are meant to operate in different environments that require alternative performance characteristics for optimum operation of the appliance 100 (e.g., enhanced suction vs. enhanced air flow).

For a fan and motor assembly 102 to generate an enhanced suction force, the air flow through the fan and motor assembly 102 is typically reduced; and to generate an enhanced air flow through the fan and motor assembly 102, the suction force is typically reduced. That is, the ability of a fan and motor assembly 102 to generate suction and air flow are inversely related. Therefore, fan and motor assemblies 102 within appliances 100 are generally designed for either enhanced suction, enhanced air flow, or a balance of suction and air flow.

Described herein are systems and methods for improving the efficiency and effectiveness of static fan and motor assemblies 102 (i.e., fan and motor assemblies 102 that are non-reconfigurable and are designed for one of enhanced suction, enhanced air flow, or a balance of suction to air flow). Also described are reconfigurable fan and motor assemblies 102 (i.e., fan and motor assemblies 102 that can be reconfigured to enhance suction, enhance air flow, or balance suction and air flow based on the function and/or environment of the appliance). That is, in some examples, the fan and motor assembly 102 may adjustable between at least (a) a first configuration in which a first level of air flow and a first level of suction are produced by the fan and motor assembly 102 and; (b) a second configuration in which a second level of air flow and a second level of suction are produced by the fan and motor assembly 102, wherein the first and second levels differ. In some examples, the first level of air flow may higher than the second level of air flow and the second level of suction may be higher than the first level of suction.

Referring now to FIG. 1A, shown therein is an exploded view of an example of a fan and motor assembly 102. The fan and motor assembly 102 may be of any shape and configuration. The fan and motor assembly 102 may be located in an air flow path that extends between an air inlet and an air outlet of an appliance 100. As illustrated, the fan and motor assembly 102 may be made up of a shield 104 (which may be referred to as a cowling or an impeller housing), a rotating fan blade subassembly 106, an optional stationary vane subassembly 108, and a motor 110. As is described in more detail subsequently, the fan and motor assembly 102 may include any number of rotating fan blade subassemblies 106, any number of the optional stationary vane subassemblies 108, and any number of motors 110 to drive rotation of any component of the fan and motor assembly 102. In some examples, the fan and motor assembly 102 may not include any stationary vane subassemblies 108. Further, in the example illustrated, the shield 104 and the rotating fan blade subassembly 106 are shown as separate components of the fan and motor assembly 102. However, the shield 104 and the rotating fan blade subassembly 106 may be formed from the same monolithic work-piece.

Still referring to FIG. 1A, the motor 110 may be any motor 110 known in the art capable of driving rotation of the rotating fan blade subassembly 106. Further, the motor 110 may be drivingly connected to the rotating fan blade subassembly 106 by any connection means known in the art. When in use, the motor 110 may rotate the rotating fan blade subassembly about an axis of rotation 170 of the motor 110 (see FIG. 1C). In the example illustrated, a distal end 112 of a drive shaft 114 of the motor 110 is threaded for engagement with the rotating fan blade subassembly 106.

Figure 1B:
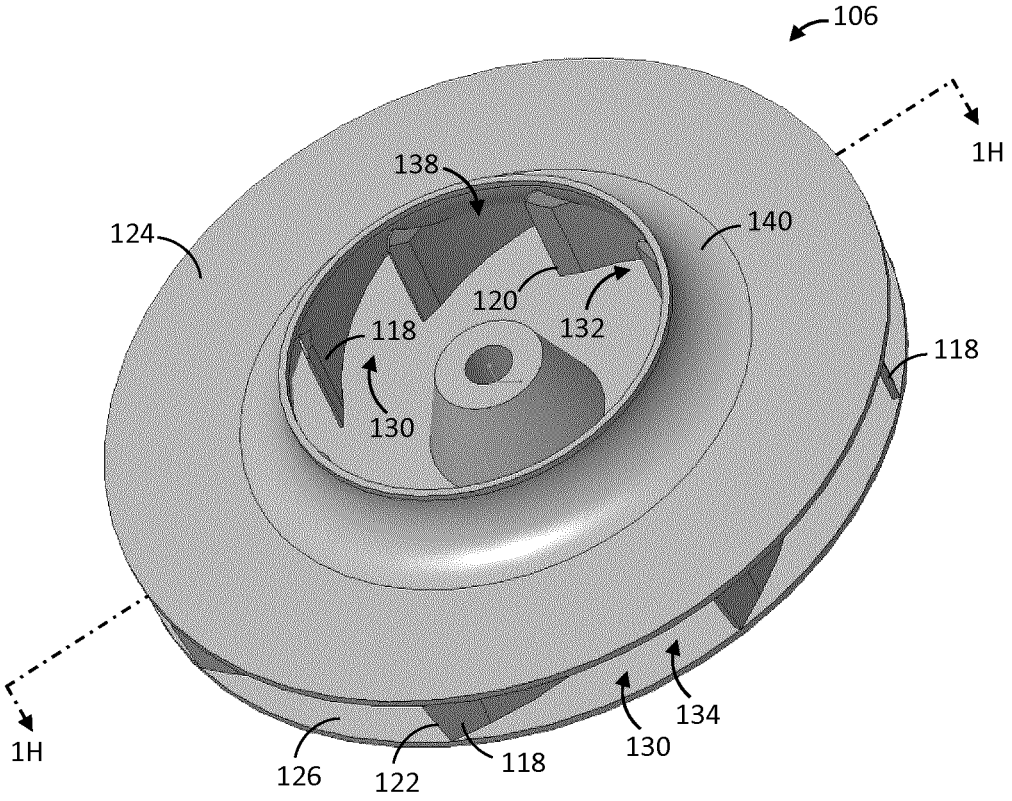
FIG. 1B is a perspective view of a rotating fan blade subassembly of the fan and motor assembly of FIG. 1A.

Referring now to FIG. 1B, shown therein is an example embodiment of a rotating fan blade subassembly 106. The rotating fan blade subassembly 106 may be of any shape and configuration, and may be made from a monolithic work-piece, or may be assembled from multiple components. As illustrated, the rotating fan blade subassembly 106 may include a plurality of rotatable blades 118 for generating an air flow through the fan and motor assembly 102 when rotated by the motor 110. Each rotatable blade 118 of the plurality of blades extends from a leading edge 120 to a trailing edge 122. It will be appreciated that the rotatable blades may be mounted in a fixed position in the rotating fan blade subassembly 106 and are rotatable as they rotate with the rotating fan blade subassembly 106.

Figure 1C:
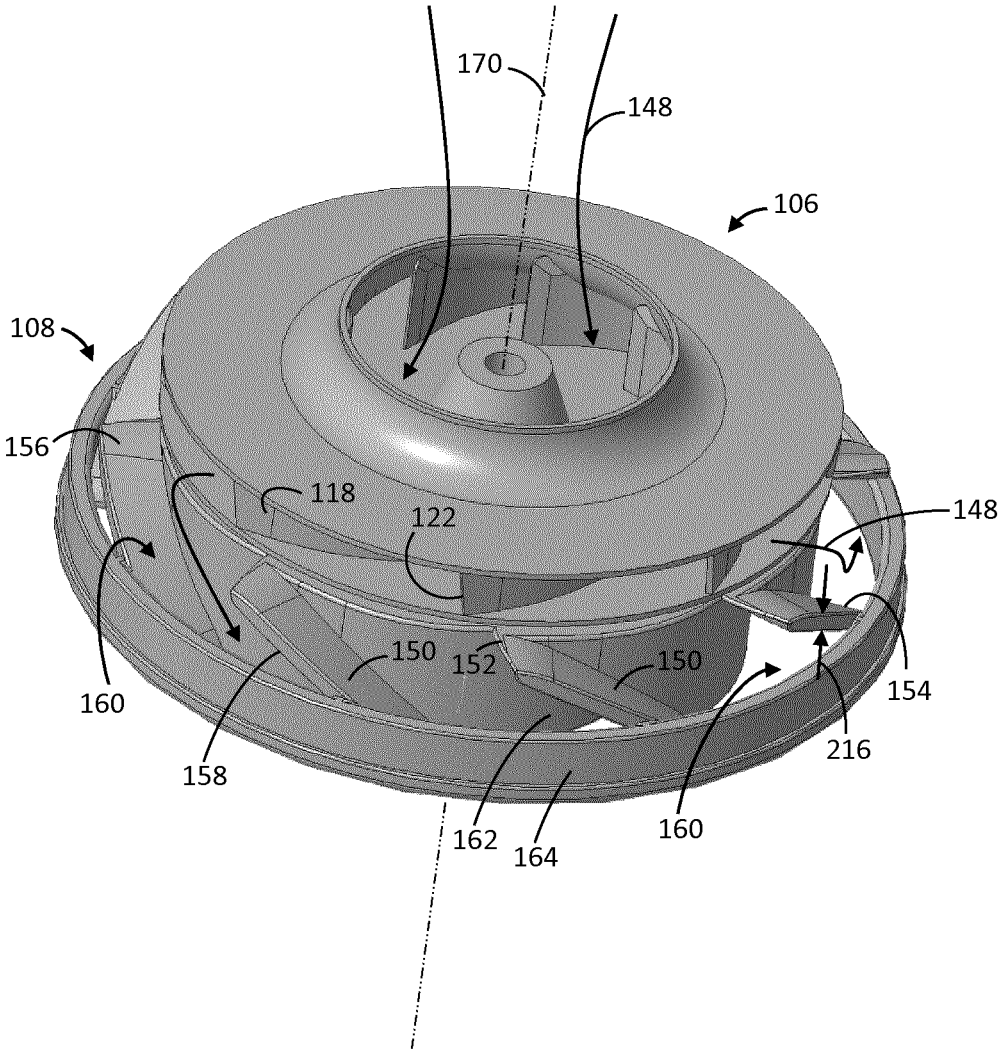
FIG. 1C is a perspective view of the rotating fan blade subassembly and a stationary vane subassembly of the fan and motor assembly of FIG. 1A.
Figure 1D:
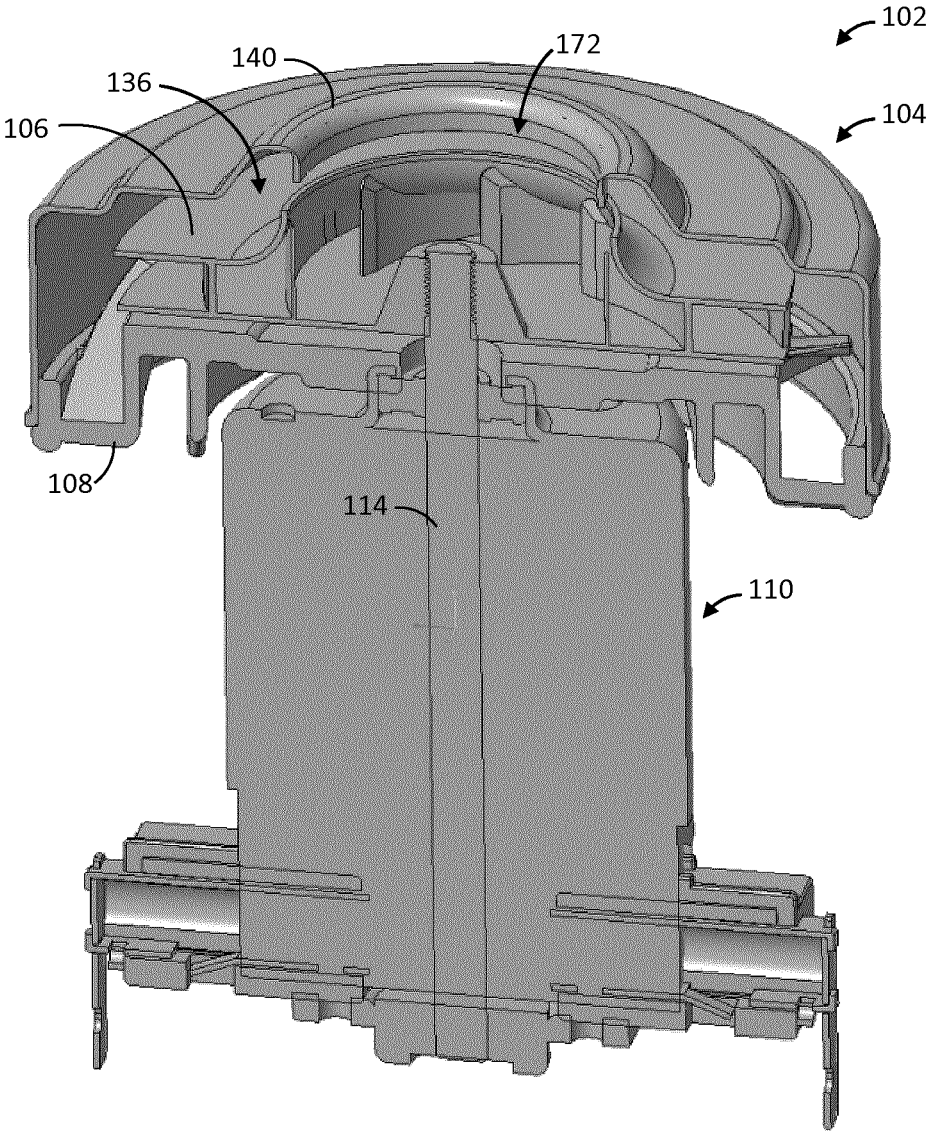
FIG. 1D is a perspective cross-sectional view of the fan and motor assembly of FIG. 1A.
Figure 1E:
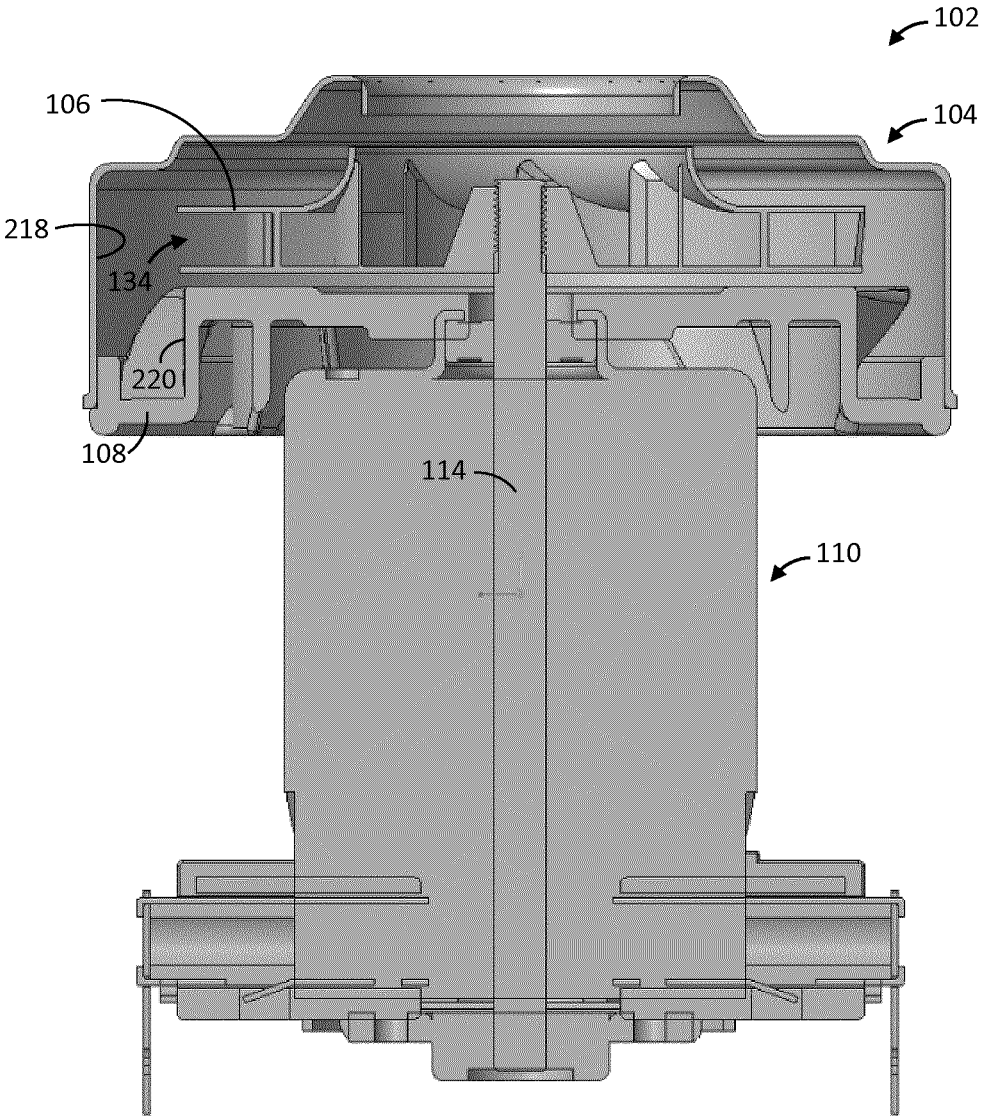
FIG. 1E is a cross-sectional view of the fan and motor assembly of FIG. 1A.
Figure 1F:
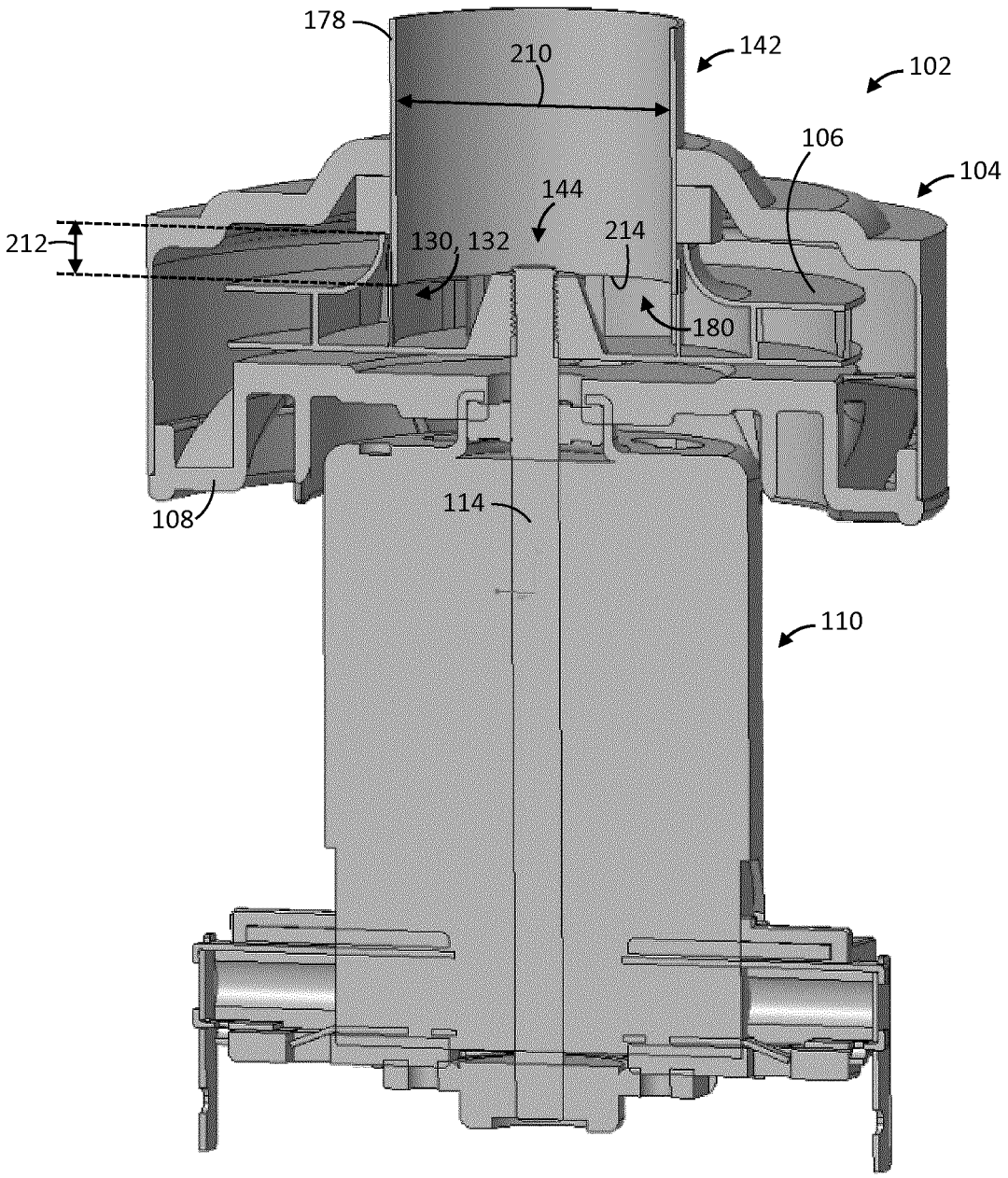
FIG. 1F is a cross-sectional view of the fan and motor assembly of FIG. 1A and a vortex finder, the vortex finder shown positioned relative to the fan and motor assembly to promote enhanced suction.
Figure 1G:
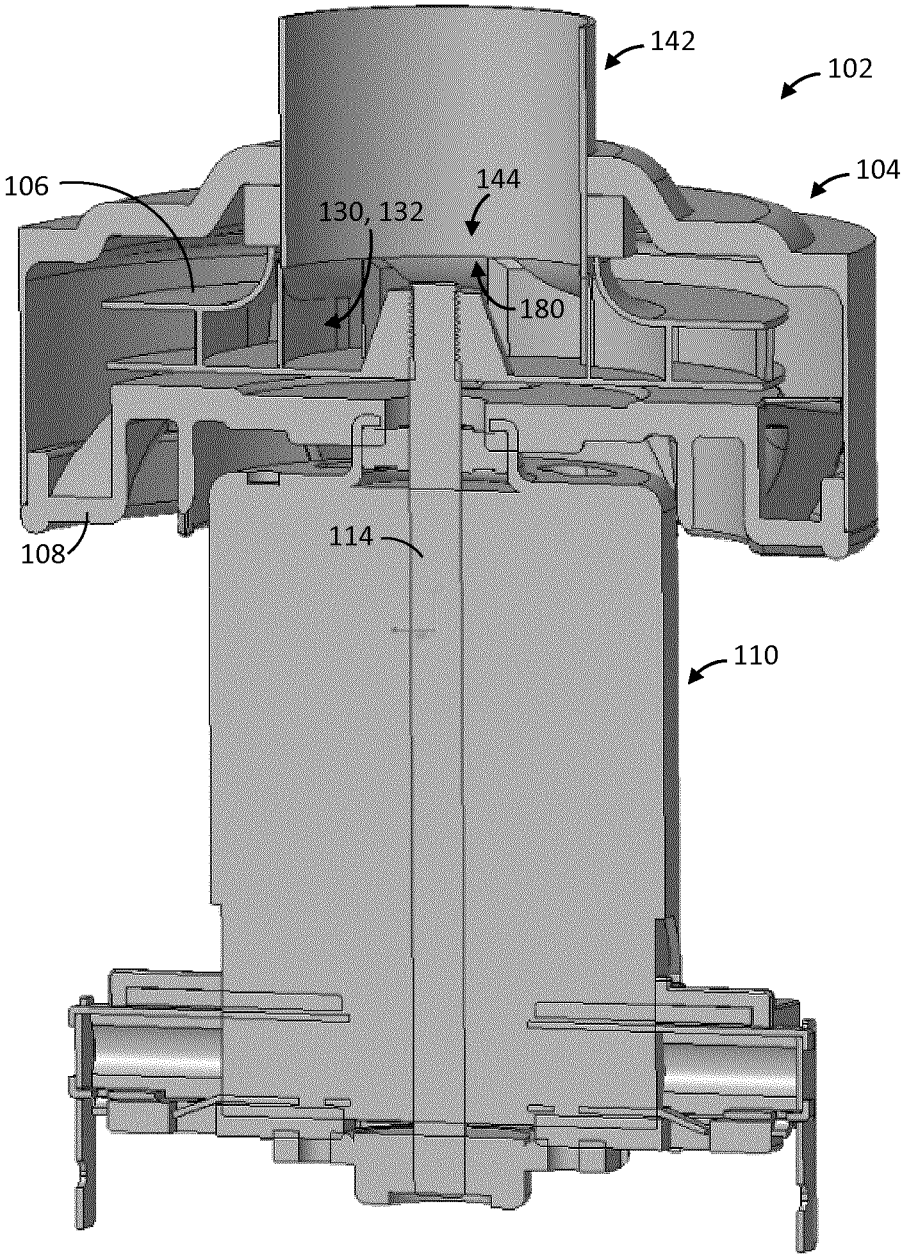
FIG. 1G is a cross-sectional view of the fan and motor assembly and the vortex finder of FIG. 1F, the vortex finder shown positioned relative to the fan and motor assembly to promote enhanced air flow.
Figure 1H:
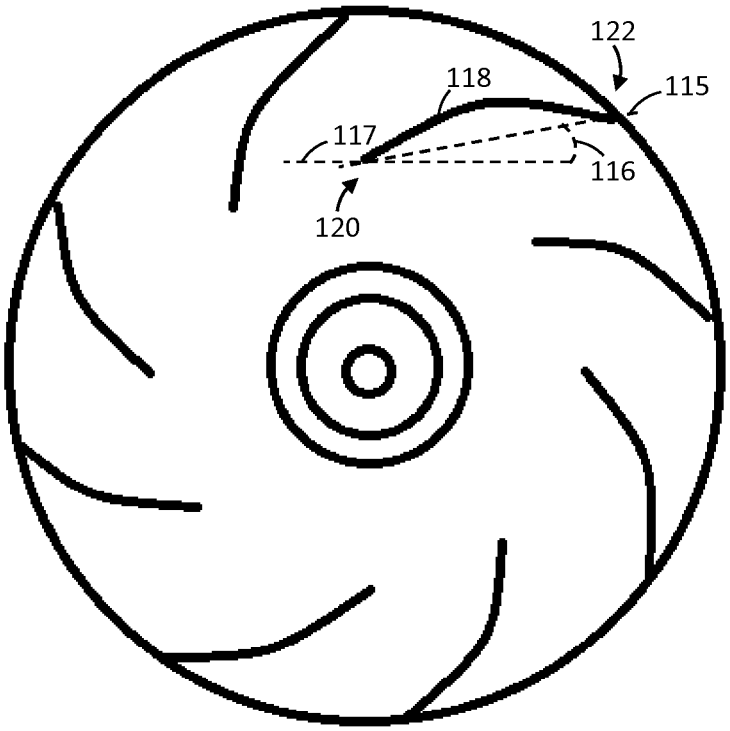
FIG. 1H is a cross-sectional view of the rotating fan blade subassembly of FIG. 1B, taken along line 1H-1H in FIG. 1B.

With reference to FIG. 1H, the leading edge 120 and the trailing edge 122 of each rotatable blade 118 of the plurality of blades define a chord 115 of the blade 118. The chord 115 and a line 117 which is tangent to the normal at the leading edge 120 of the blade 118 defines a pitch 116 (i.e., blade angle). In the example illustrated in FIGS. 1A to 1H, the pitch 116 of each rotatable blade 118 is fixed. In some examples, the pitch 166 of each rotatable blade 118 may be adjustable. Adjusting the pitch 116 of the rotatable blades 118 may alter the performance characteristics of the rotating fan blade subassembly 106. Any means known in the art for adjusting the pitch 116 of a blade 118 may be used.

Referring back to FIG. 1B, in the example illustrated, the rotatable blades 118 are enclosed by an upper wall 124 and a lower wall 126. The rotatable blades 118, the upper wall 124, and the lower wall 126 together define a plurality of fan blade air channels 130. As shown, each fan blade air channel of the plurality of fan blade air channels 130 extend from a fan blade air channel inlet 132 to a fan blade air channel outlet 134. Each of the fan blade air channel inlets 132 of the plurality of fan blade air channels 130 may collectively be referred to as an entrance to the plurality of fan blade air channels 130. The fan blade air channels 130 are in fluid flow communication with an inlet 138 of the rotating fan blade subassembly 106. In the example illustrated, the inlet 138 extends through the upper wall 124 of the rotating fan blade subassembly 106, and the inlet 138 is centrally located within the upper wall 124.

Optionally, as shown, a flange 140 may extend about the inlet 138 of the rotating fan blade subassembly 106. The flange 140 may improve the seal between the rotating fan blade subassembly 106 and a conduit (e.g., a vortex finder which is not shown) that may connect the rotating fan blade subassembly 106 in air flow communication with the inlet and/or outlet (not shown) of the appliance 100. In some examples, as described in detail below, a vortex finder 142 may be positioned between the conduit extending from the inlet and/or outlet of the appliance 100 and the rotating fan blade subassembly 106. Accordingly, the flange 140 may improve the seal between the rotating fan blade subassembly 106 and the vortex finder 142.

As described previously, in some examples, the fan and motor assembly 102 may include a stationary vane subassembly 108. Referring now to FIG. 1C, shown therein is an example of the rotating fan blade subassembly 106 as described previously and an example of a stationary vane subassembly 108. The stationary vane subassembly 108 may be of any shape or configuration and may be made of a single monolithic work-piece or may be made of a plurality of components.

The rotating fan blade subassembly 106 and the stationary vane subassembly 108 may be provided as part of a motor and fan assembly by any means known in the art. Each of the rotating fan blade subassembly 106 and the stationary vane subassembly 108 may be mounted in a common housing and they may be connected to each other, e.g., by the motor shaft that drives the rotating fan blade subassembly 106 extending through the stationary vane subassembly 108.

The stationary vane subassembly 108 may be rotatable, although at a different (e.g., slower) rate than the rotating fan blade subassembly 106, and therefore rotatable relative to the rotating fan blade subassembly 106. Therefore, in one aspect that may be used by itself or in combination with any one or more features set out herein, although referred to as a stationary vane subassembly 108, the stationary vane subassembly 108 may be rotatable. For example, a second motor 110 may be included in the fan and motor assembly 102 to drive rotation of the stationary vane subassembly 108. Alternatively, the motor 110 used to drive rotation of the rotating fan blade subassembly 106 may also drive rotation of the stationary vane subassembly 108. That being said, when driven by the same motor 110 as the rotating fan blade subassembly 106, a gear set, or other means (e.g., frictional rotation limited by a brake), may be implemented so that the rotational speed of the stationary vane subassembly 108 is less than that of the rotating fan blade subassembly 106. In any embodiment, the stationary vane subassembly 108 may rotate, even at a very low RPM compared to that of the rotating fan blade subassembly 106, as this may reduce the amount of noise produced by the fan and motor assembly 102, when in use.

As shown, the stationary vane subassembly 108 may be positioned downstream of the rotating fan blade subassembly 106. That is, an air flow path 148 extends through the fan and motor assembly 102, and the air flow path 148 may extend from rotating fan blade subassembly 106 to the stationary vane subassembly 108.

As exemplified in FIG. 1C, the stationary vane subassembly 108 includes a plurality of vanes 150 that redirect the air flow 148 after it passes through the rotating fan blade subassembly 106. As described below, the position, shape, and orientation of the vanes 150 may affect the performance characteristics of the fan and motor assembly 102.

Optionally, in one aspect that may be used by itself or in combination with any one or more features set out herein, the vanes 150 can be made out of silicon or foam so they are flexible and can "move" when impacted by the air flow (i.e., materials that "absorb noise").

Each vane 150 of the plurality of vanes has a leading edge 152 and a trailing edge 154 in a direction of rotation of the rotating fan blade subassembly 106. Each vane 150 also has an upper face 156 extending from the leading edge 152 to the trailing edge 154, as well as a lower face 158 extending from the leading edge 152 to the trailing edge 154. The upper face 156 of one vane 150 and the lower face 158 of an adjacent vane 150 define, in part, a plurality of stationary vane air channels 160 that extend through the stationary vane subassembly 108. The stationary vane air channels 160 may also be defined, in part, by an inner hub 162 and an outer hub 164 of the stationary vane subassembly 108.

Similar to the rotating fan blade subassembly 106, as described above, in one aspect that may be used by itself or in combination with any one or more features set out herein, in some examples of the stationary vane subassembly 108, a pitch of each vane 150 of the plurality of vanes may be adjustable.

As exemplified, in examples of a fan and motor assembly 102 that include a stationary vane subassembly 108, the plurality stationary vane air channels 160 are downstream of the rotating fan blade subassembly 106 and may be positioned radially outwardly of the rotating fan blade subassembly 106. Accordingly, the leading edge 152 may be located at or radially outward of the trailing edge 122 of each rotatable blade 118.

Optionally, in one aspect that may be used by itself or in combination with any one or more features set out herein, the leading edge 152 of each vane 150 of the plurality of vanes within the stationary vane subassembly 108 may be angularly spaced apart, along the axis of rotation 170 of the rotating fan blade subassembly 106, in the direction of air flow 148, from the trailing edge 122 of each rotatable blade 118 of the plurality of blades of the rotating fan blade subassembly 106.

Optionally, in one aspect that may be used by itself or in combination with any one or more features set out herein, the distance between the leading edge 152 of the vanes 150 and the trailing edge 122 of the rotating fan blade subassembly 106, along the rotational axis 170 of the rotating fan blade subassembly 106 may be adjustable. That is, the alignment of the plurality of vanes may be adjustable between a first position and a second position.

When the angular spacing between the rotating fan blade subassembly 106 and the stationary vane subassembly 108 is relatively small, the fan and motor assembly 102, when in use, may be more able to generate suction force. Whereas, when the angular spacing between the rotating fan blade subassembly 106 and the stationary vane subassembly 108 is relatively large, the fan and motor assembly 102, when in use, may be more able to generate high air flow.

Referring now to FIG. 1D, as illustrated, the shield 104 of the fan and motor assembly 102 may direct the air flowing radially outwardly from the rotating fan blade subassembly 106 downwardly towards the stationary vane subassembly 108.

The shield 104 may be of any shape and configuration that promotes fluid flow through the fan and motor assembly 102. In the example illustrated, the shield 104 has an opening 172 through which a conduit or the vortex finder 142 may pass through to fluidically connect the rotating fan blade subassembly 106 to the inlet and/or outlet of the appliance 100. As illustrated, a flange 140 (i.e., seal) may extend about the opening 172 of the shield 104.

In some examples, a first end 136 of the rotating fan blade subassembly 106 may be spaced from and facing the shield 104. Accordingly, as shown in FIG. 1D, a gap may be provided between the shield 104 and the first end 136. In some examples, as described in more detail subsequently, the gap between the first end 136 of the rotating fan blade subassembly 106 and the shield 104 may be variable. Any means known in the art for adjusting the relative position between the first end 136 of the rotating fan blade subassembly 106 and the shield 104 may be used, such as moving the motor shaft towards or away from the shield 104.

In the example illustrated, the motor 110 of the fan and motor assembly 102 is positioned below the stationary vane subassembly 108 (i.e., the stationary vane subassembly 108 is positioned between the rotating fan blade subassembly 106 and the motor 110). Accordingly, the drive shaft 114 of the motor may extend through the stationary vane subassembly 108. In other embodiments, the motor 110 may be otherwise located.

General Description of a Vortex Finder

In accordance with one aspect of this disclosure, which may be used by itself or in combination with any other aspect of this disclosure, the fan and motor assembly 102 is in fluid flow communication with a vortex finder 142 which is configurable to alter the performance characteristics of the fan and motor assembly 102.

For example, the vortex finder 142 may be reconfigurable by varying the positioning of the vortex finder 142 with respect to the inlet to the rotating fan blade subassembly 106. Movement of the vortex finder 142 with respect to the inlet to the rotating fan blade subassembly 106 adjusts the location at which air enters the fan and motor assembly 102 and in particular the rotating fan blade subassembly 106. The vortex finder 142 can be of any shape and configuration that allows for the entry point of the air into the fan and motor assembly 102 to be adjusted. It will be appreciated that one or both of the vortex finder and the rotating fan blade subassembly 106 may be moveable with respect to the other. Accordingly, the position of one or both may be axially adjustable. Alternately, or in addition, the vortex finder may be telescoping so that the location of the outlet of the vortex finder is adjustable.

Alternately, or in addition, the diameter of the vortex finder 142 may also be adjustable to alter the performance characteristics of the fan and motor assembly 102. For example, the vortex finder may have a flow constrictor which opens or closes all or a portion of the air flow path through the vortex finder 142. The flow constrictor may be a valve, an iris or the sidewall defining the vortex finder may be adjusted to increase or decrease the diameter of the vortex finder. Optionally, an adjustable iris is provided at the outlet of the vortex finder and/or the inlet to the fan and motor assembly 102.

As described previously, the performance characteristics of the fan and motor assembly 102 may be adjusted depending on the selected function of the appliance 100, as well as the environment in which the appliance 100 is operating. That is, in some cases, the fan and motor assembly 102 may produce enhanced suction, whereas, in other cases, the fan and motor assembly 102 may produce enhanced air flow. Alternatively, the fan and motor assembly 102 may operate such that the suction and air flow are balanced.

Referring now to FIG. 1F, in the example illustrated, a vortex finder 142 is shown in fluid flow communication with the rotating fan blade subassembly 106. Specifically, in the example illustrated, the vortex finder 142 has an outlet 144 in communication with the inlet 138 of the first rotating fan blade subassembly 106.

As shown, the vortex finder 142 may be a conduit 178 which is movable from a first position, in which, when in use, the appliance 100 exhibits enhanced air flow (see FIG. 1G wherein the outlet 144 of the vortex finder 142 is located at the upper end of the entrance to the air flow channels in the rotating fan blade subassembly 106), to a second position, in which, when in use, the appliance 100 exhibits enhanced suction (see FIG. 1F wherein the outlet 144 of the vortex finder blocks part of the entrance to the air flow channels in the rotating fan blade subassembly 106). That is, when the vortex finder 142 is in the first position, the air flow generated by the fan and motor assembly 102 is greater than the air flow generated by the fan and motor assembly 102 when the vortex finder 142 is in the second position. Further, when the vortex finder 142 is in the first position, the suction generated by the fan and motor assembly 102 is lower than the suction generated by the fan and motor assembly 102 when the vortex finder 142 is in the second position. The vortex finder 142 may also be positioned at any location between the first and second positions, in which the suction force and air flow may be balanced.

As shown in FIG. 1F, when in the second position (i.e., positioned for enhanced suction), a distal end 180 of the vortex finder 142 extends through the opening 172 of the shield 104 and the inlet 138 of the rotating fan blade subassembly 106 to a position in which the distal end 180 blocks a portion of the inlets 132 to the fan blade air channels 130 (i.e., the entrance to the plurality of fan blade air channels 130) of the rotating fan blade subassembly 106.

As shown in FIG. 1G, when in the first position (i.e., positioned for enhanced air flow), the vortex finder 142 is positioned so that the distal end 180 of the vortex finder 142 does not block the inlets 132 to the fan blade air channels 130 (i.e., the entrance to the plurality of fan blade air channels 130) of the rotating fan blade subassembly 106.

Therefore, by varying the position of the distal end 180 of the vortex finder 142 relative to the entrance to the plurality of fan blade air channels 130, the air flow and suction may be varied. Withdrawing the vortex finder will increase air flow while inserting the vortex finder will increase suction.

Movement of the vortex finder 142 can be controlled by any means known in the art. For example, a user of the appliance 100 may manually move the vortex finder 142 or an actuator drivingly connected to the vortex finder 142. For example, a handle 204 may be driving connected to the vortex finder 142. Accordingly, moving handle 204 from the position shown in FIG. 12A to the position shown in FIG. 12B may move the vortex finder 142. The handle 204 may be mechanically driving connected to the vortex finder 142 by a mechanical linkage. Alternately, an actuator may be driving connected to the vortex finder 142. The appliance 100 may sense the position of handle 204 and send a signal to the actuator, e.g., solenoid, based on the position of handle 204.

The actuator may be, for example, a thermomechanical member (e.g., muscle wire that changes length when heated or a bimetallic strip which changes configuration), an electromechanical actuator such as a solenoid or a stepper motor or the like, a fluidic motor, or a hydraulic motor.

Alternatively, the actuator may be signaled to move the vortex finder 142 based on an input from a user. For example, when a user selects a mode on the appliance 100 (e.g., for a surface cleaning apparatus bare floor cleaning or carpet cleaning or, for a hair dryer, a suction drying mode or a blow dry mode), the actuator may automatically move the vortex finder 142 to the appropriate location so that the fan and motor assembly 102 is configured for the selected function (e.g., a function that requires higher suction or a function that requires higher air flow).

Alternatively, a sensor may be used to detect the environment in which the appliance 100 is being used, and the sensor may signal the actuator to position the vortex finder 142 accordingly. Any sensor known in the art may be used. For example, the sensor may be an optical sensor to detect the type of floor being cleaned (e.g., carpet or hardwood and to increase air flow when a hard floor surface is detected), a proximity sensor (e.g., to detect the proximity of hair to a suction inlet of a hair dryer and increase suction when hair is positioned proximate a suction inlet of a hair dryer) or a temperature sensor (e.g., to detect the temperature of air exiting a hair dryer or the temperature of hair being dried by a hair dryer and increase the air flow rate when the temperature exceeds a predetermined temperature).

Alternatively, any measurable characteristic of the fan and motor assembly 102 or the appliance 100 in which the fan and motor assembly 102 is located may be monitored by the sensor. Accordingly, the sensor may be, for example, a pressure sensor (e.g., to increase the air flow when the pressure is greater than a predetermined pressure) or a flow sensor (e.g., to increase suction when air flow is below a predetermined air flow).

As a specific example, a diaphragm or a piston may be capable of detecting a change in pressure across the fan and motor assembly 102. Based on the pressure change, the actuator may be signaled to move the vortex finder 142 to the enhanced suction position or the enhanced air flow position.

In another embodiment, the vortex finder 142 may remain stationary, and the fan and motor assembly 102 may be moved to adjust the relative position between the vortex finder 142 and the fan and motor assembly 102.

It will be appreciated that the actuators and/or the sensors described herein may be used to operate any reconfiguration of a motor and fan assembly described herein.

General Description of Shield Materials

In accordance with one aspect of this disclosure, which may be used by itself or in combination with any other aspect of this disclosure, a significant portion or all of the shield 104 directly adjacent to the rotating fan blade subassembly 106 may be made from a material that absorbs sound so that the noise of the fan and motor assembly 102, when in use, is reduced.

Example materials that absorb sound include, but are not limited to, cross linked plastic foam, polyethylene, cross linked polyethylene such as closed cell cross linked polyethylene, balsa wood, woven bamboo matrix, bamboo, plastic, composite, or a combination of these, and optionally a combination of these plus metal.

Figure 2:
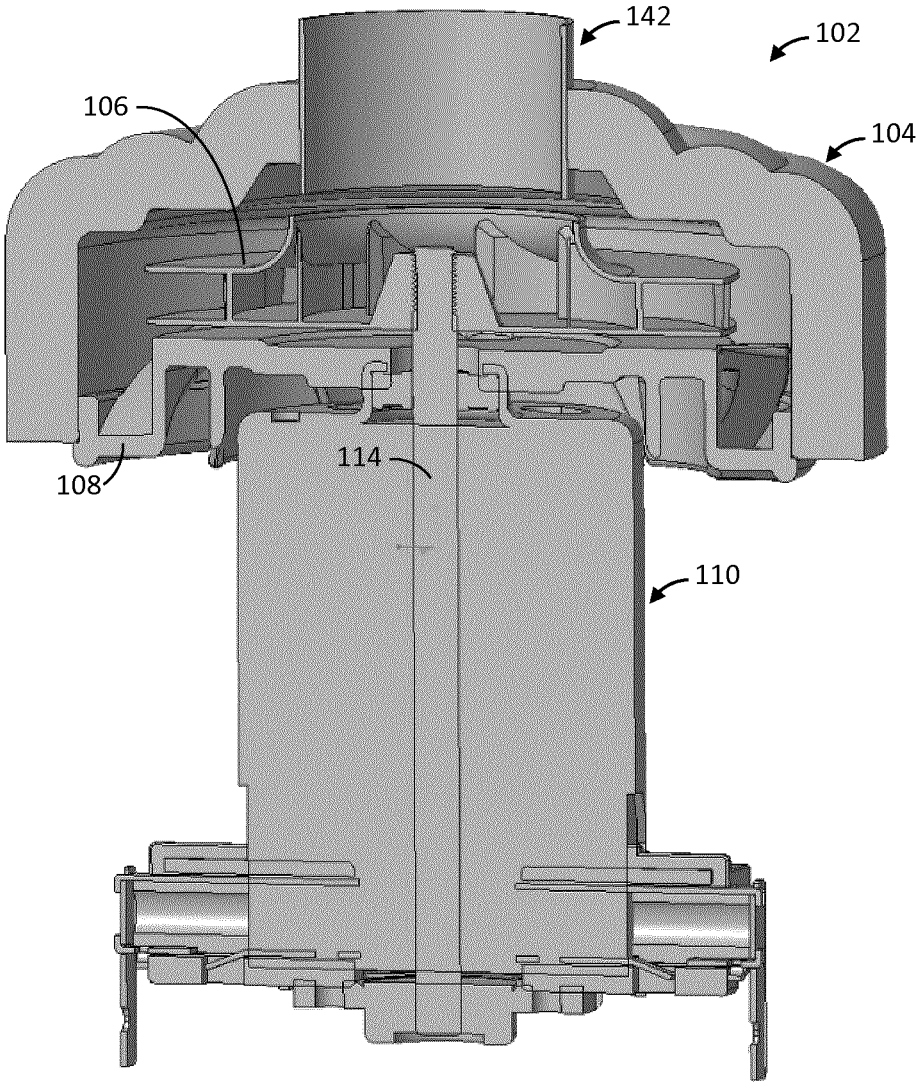
FIG. 2 is a cross-sectional view of an alternative embodiment of a fan and motor assembly and a vortex finder.
Figure 3:
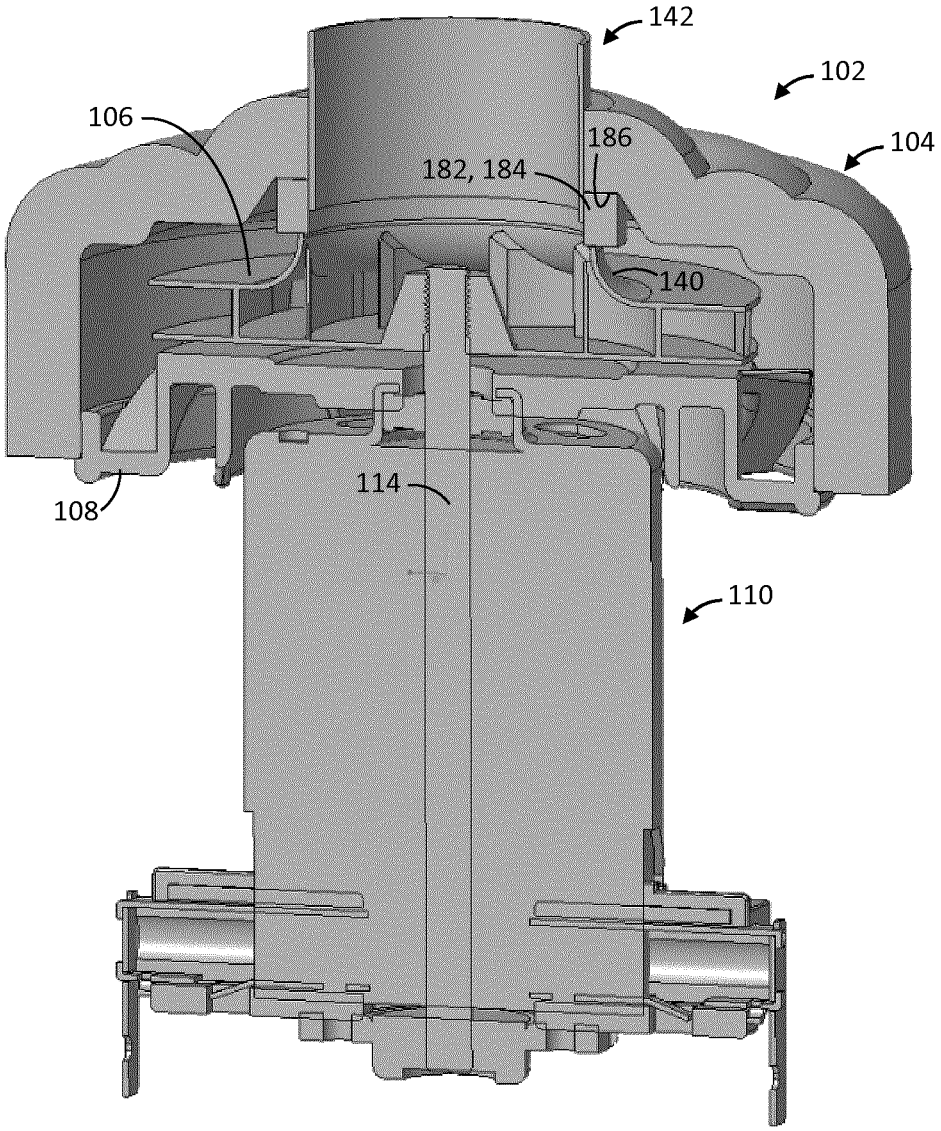
FIG. 3 is a cross-sectional view of a further alternative embodiment of a fan and motor assembly and a vortex finder.

Referring to FIGS. 2 and 3, in the examples illustrated, the shield 104 of the fan and motor assembly 102 is formed of a closed cell cross linked polyethylene.

When the shield 104 is formed of a sound absorbent material, such as those described above, optionally, a thin metal or plastic or composite tube (not shown) may be bonded or mechanically affixed to the shield 104 to form the opening 172 of the shield 104 through which the conduit and/or vortex finder 142 may extend through.

The opening 172 may be made from a thin metal or plastic composite tube because the sound absorbent materials may be unable to form a proper seal between the shield 104 and the conduit and/or the vortex finder 142. Further, the sound absorbent materials described above may wear down, and therefore form a weak seal, after continued movement of the vortex finder 142. Accordingly, the opening 172, i.e., the mating region between the conduit and/or the vortex finder 142, may be formed of a material such as plastic or metal.

General Description of a Seal Between the Rotating Fan Blade Subassembly and Shield In accordance with one aspect of this disclosure, which may be used by itself or in combination with any other aspect of this disclosure, there may be a seal 182 located between the rotating fan blade subassembly 106 and the shield 104.

As exemplified in FIG. 3, a seal 182 located between the rotating fan blade subassembly 106 and the shield 104 may promote air to flow from the conduit and/or vortex finder 142 through the fan blade air channels 130 as opposed to around the rotating fan blade subassembly 106. That is, the seal 182 may be positioned between the rotating fan blade subassembly 106 and the shield 104 so that air entering the fan and motor assembly 102 is inhibited from bypassing the plurality of fan blade air channels 130. If two rotating fan blade subassemblies are provided, then a seal 182 may be provided between a vortex finder and one or both of the fan blade subassemblies.

The seal 182 may be formed from any sealing means known in the art. For example, the seal 182 may be a bushing or a sealed bearing 184. Specifically, the bushing 184 may be a high-speed rotatable bushing.

Referring to FIG. 3, in the example illustrated, the rotating high-speed bushing 184 is positioned between the flange 140 extending about the inlet 138 to the rotating fan blade subassembly 106 and an inner face 186 of the shield 104.

Alternately or in addition, the fan and motor assembly 102 may include a biasing device (not shown) which may exert a small down force pressure on the shield 104, with respect to the rotating fan blade subassembly 106, or vice versa, to offset wear of the seal 182 over time. That is, as the seal 182 wears due to rotation of the rotating fan blade subassembly 106, the distance between the shield 104 and the rotating fan blade subassembly 106 may be reduced by a biasing member or an actuator to ensure a proper seal is formed by the seal 182.

General Description of Vane Spacing within a Stationary Vane Subassembly

The spacing of the vanes 150 within the stationary vane subassembly 108 may affect the performance characteristics of the fan and motor assembly 102. As described below, the vane spacing may be static (i.e., may be designed for enhanced suction, enhanced air flow, or a balance between suction and air flow) or may be reconfigurable based on the desired performance characteristics of the appliance 100.

No Overlap Between Adjacent Vanes within a Stationary Vane Subassembly

In accordance with one aspect of this disclosure, which may be used by itself or in combination with any other aspect of this disclosure, there may be no overlap between adjacent vanes 150 within a stationary vane subassembly 108.

Overlap refers to the angular distance between the trailing edge 154 of one vane 150 to the nearest leading edge 152 of an adjacent vane 150 in a direction transverse to the rotational axis 170 of the rotating fan blade subassembly 106.

Figure 4A:
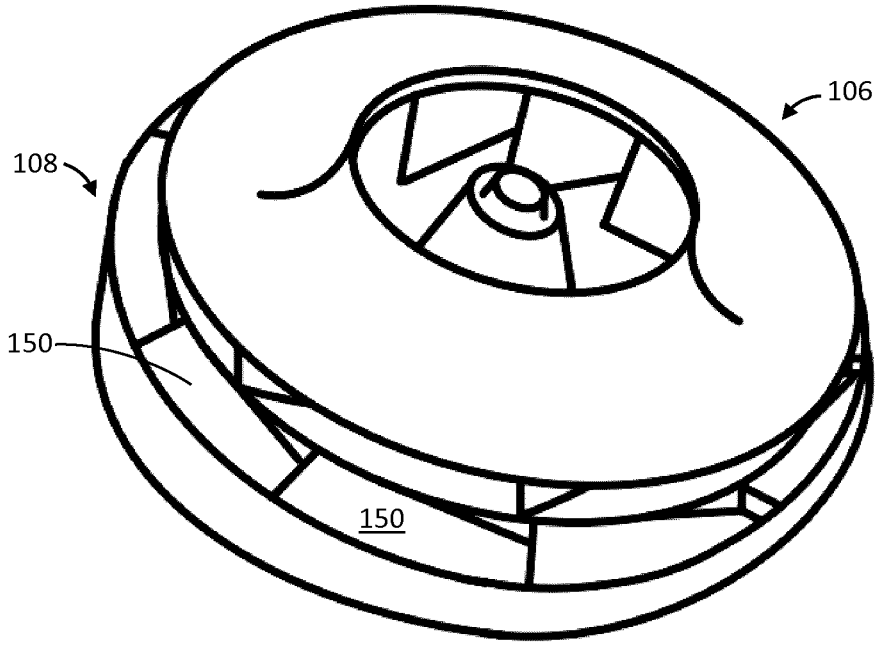
FIG. 4A is a perspective view of a further alternative embodiment of a rotating fan blade subassembly and a stationary vane subassembly.
Figure 4B:
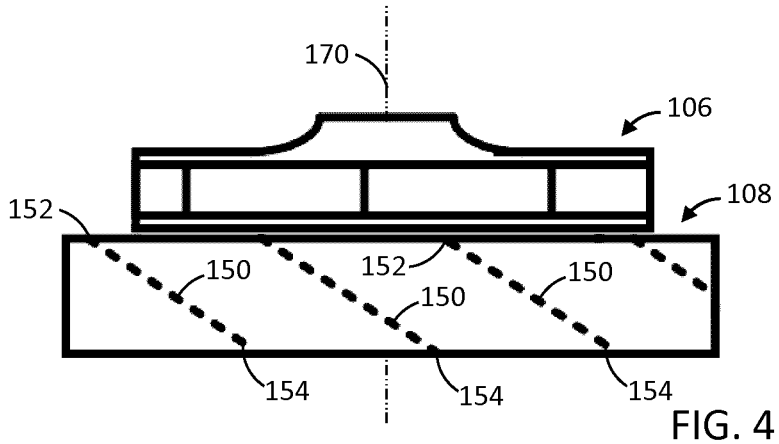
FIG. 4B is a side view of the rotating fan blade subassembly and the stationary vane subassembly of FIG. 4A.
Figure 4C:
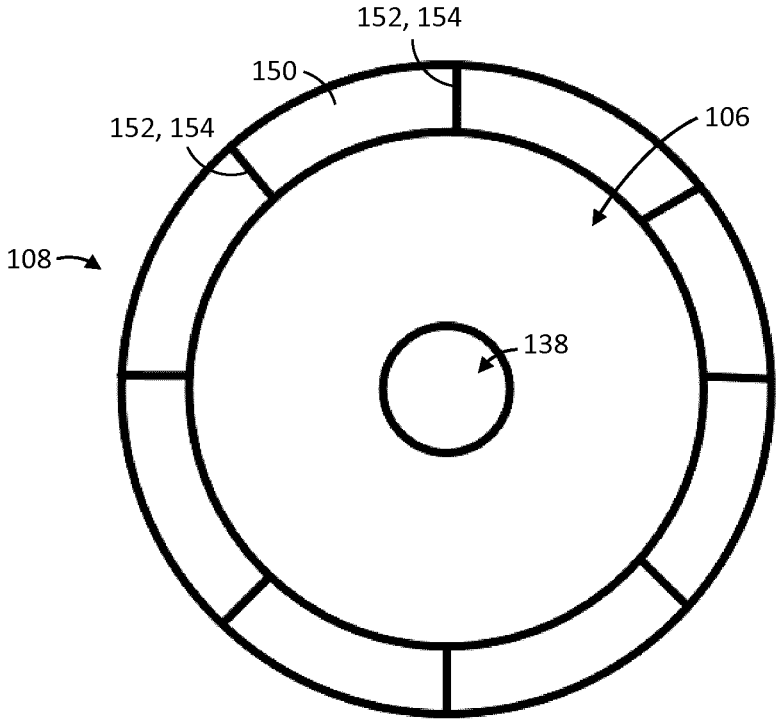
FIG. 4C is a top view of the rotating fan blade subassembly and the stationary vane subassembly of FIG. 4A.

Referring to FIG. 4B, in the example illustrated, there is no overlap between the leading edges 152 and trailing edges 154 of adjacent vanes 150. That is, as exemplified in the top plan view of FIG. 4C, the leading edge 152 of one vane 150 is in line with the trailing edge 154 of an adjacent vane 150 along the axis of rotation 170 of the rotating fan blade subassembly 106.

When the vanes 150 of the stationary vane subassembly 108 are positioned so that there is no overlap, the suction force generated by the fan and motor assembly 102, when in use, is greater than that if there was is a negative overlap as discussed subsequently.

Optionally, in one aspect that may be used by itself or with any one or more other aspects set out herein, the leading edge 152 of the vanes 150 may be curved (not shown). Specifically, in the direction of air flow 148 through the stationary vane subassembly 108, the leading edge 152 may be concave (e.g., when view from above in a top plan view).

Negative Overlap Between Adjacent Vanes within a Stationary Vane Subassembly

In accordance with one aspect of this disclosure, which may be used by itself or in combination with any other aspect of this disclosure, there may be negative overlap between adjacent vanes 150 within a stationary vane subassembly 108.

Figure 5A:
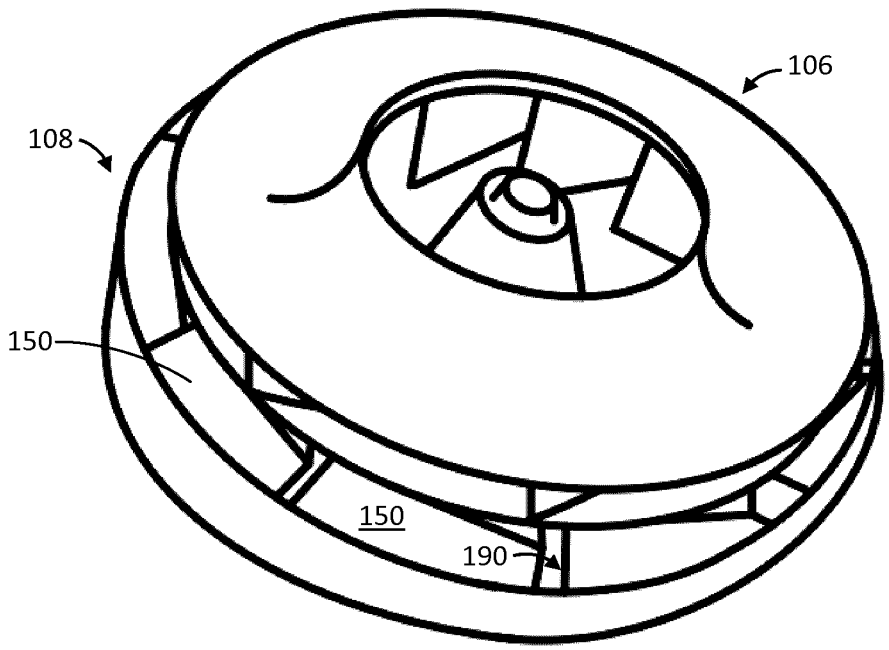
FIG. 5A is a perspective view of a further alternative embodiment of a rotating fan blade subassembly and a stationary vane subassembly.
Figure 5B:
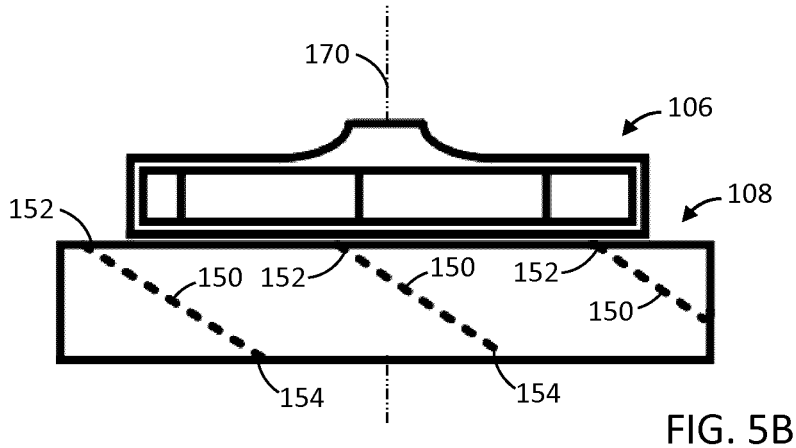
FIG. 5B is a side view of the rotating fan blade subassembly and the stationary vane subassembly of FIG. 5A.

Referring to FIG. 5B, in the example illustrated, there is negative overlap between the leading edges 152 and the trailing edges 154 of adjacent vanes 150. That is, the leading edge 152 of one vane 150 is angularly spaced apart from the nearest trailing edge 154 of an adjacent vane 150 in a direction transverse to the axis of rotation 170 of the rotating fan blade subassembly 106.

Figure 5C:
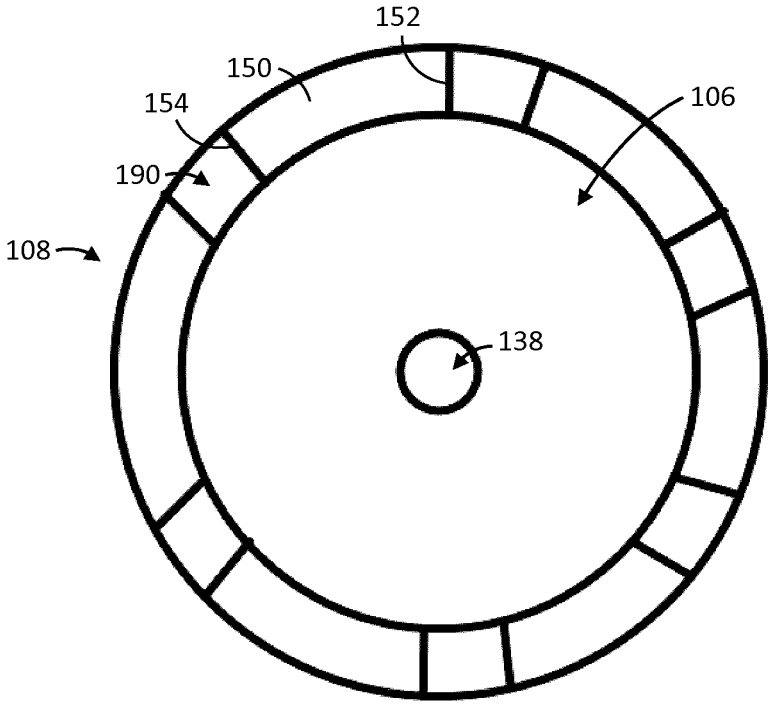
FIG. 5C is a top view of the rotating fan blade subassembly and the stationary vane subassembly of FIG. 5A.

Accordingly, the negative overlap creates a plurality of bypass air gaps 190 (see FIG. 5C) within the stationary vane subassembly 108 that extend through the stationary vane air channels 160 along the axis of rotation 170 of the rotating fan blade subassembly 106. That is, air may flow parallel to the rotational axis 170 of the rotating fan blade subassembly 106 through the stationary vane subassembly 108 without contacting a vane 150 of the stationary vane subassembly 108.

When the vanes 150 of the stationary vane subassembly 108 are positioned so that there is negative overlap between adjacent vanes 150, the air flow generated by the fan and motor assembly 102, when in use, is greater than that if there was no overlap and suction is reduced.

Adjustable Spacing Between Adjacent Vanes within a Stationary Vane Subassembly

In accordance with one aspect of this disclosure, which may be used by itself or in combination with any other aspect of this disclosure, the spacing between adjacent vanes 150 within a stationary vane subassembly 108 may be adjustable.

A stationary vane subassembly 108 may have adjustable vane spacing so that the performance characteristics of the fan and motor assembly 102 can be configured according to the function and/or operating environment of the appliance 100 in which the fan and motor assembly 102 are installed.

Any means known in the art to adjust the spacing between adjacent vanes 150 within a stationary vane subassembly 108 may be used. For example, any actuator and any sensor described herein may be used.

Figure 6A:
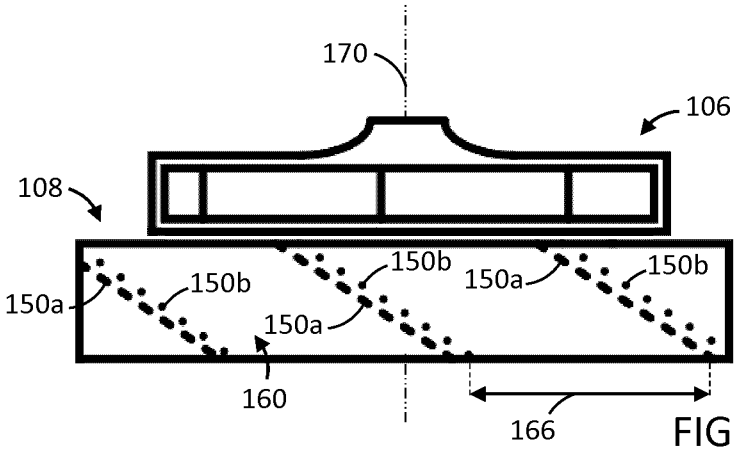
FIG. 6A is a side view of a further alternative embodiment of a rotating fan blade subassembly and a stationary vane subassembly, a first set of vanes of the stationary vane subassembly shown in contact with a second set of vanes of the stationary vane subassembly.
Figure 6B:
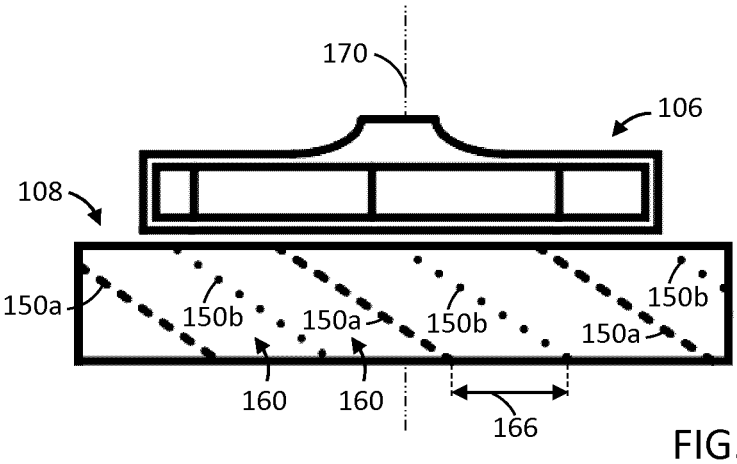
FIG. 6B is a side view of the rotating fan blade subassembly and the stationary vane subassembly of FIG. 6A, the first set of vanes of the stationary vane subassembly shown spaced apart from the second set of vanes of the stationary vane subassembly.

As exemplified in FIGS. 6A and 6B, the stationary vane subassembly 108 may have a first set of vanes and a second set of vanes. Each vane 150*a* of the first set of vanes is separated from an adjacent vane 150*a* of the first set of vanes by a vane 150*b* of the second set of vanes. As shown, a plurality of stationary vane air channels 160 are formed by the first set of vanes 150*a* and the second set of vanes 150*b*.

In the example illustrated, the second set of vanes 150*b* are rotatable with respect to the first set of vanes 150*a*. Accordingly, the second set of vanes may be positioned such that each vane 150*b* of the second set of vanes is in contact with or adjacent a vane 150*a* of the first set of vanes (see, FIG. 6A). In this position, the first set of vanes and the second set of vanes may together define a stationary vane subassembly 108 with negative overlap between adjacent vanes 150. In this configuration, a width 166 of the stationary vane air channels 160 through the stationary vane subassembly 108 is increased which enhances air flow through the stationary vane subassembly.

If the second set of vanes is rotated away from the first set of vanes, the number of air flow channels in the stationary vane subassembly is increased. In this configuration, the width 166 of the stationary vane air channels 160 through the stationary vane subassembly 108 is decreased which enhances suction.

It will be appreciated that the second set of vanes may be rotated away from the first set of vanes and the first and second set of vanes may define a stationary vane subassembly 108 with no overlap or negative overlap between adjacent vanes 150.

As shown in FIG. 6B, the second set of vanes may be positioned so that each vane 150*b* of the second set of vanes is positioned at an equidistance to each adjacent vane 150*a* of the first set of vanes. It is to be understood that the second set of vanes can be positioned at any distance between adjacent vanes 150*a* of the first set of vanes.

Alternately, or in addition, the axial position of the rotating fan blade assembly to the stationary vane assembly may also be adjustable.

Adjustable Spacing Between Vanes within a Dual Stationary Vane Subassembly

In accordance with one aspect of this disclosure, which may be used by itself or in combination with any other aspect of this disclosure, the fan and motor assembly 102 may include at least a second stationary vane subassembly 108*b*.

The second stationary vane subassembly 108*b* may be of any shape and configuration. The second stationary vane subassembly 108*b* may have the same shape and configuration as the first stationary vane subassembly 108, or a different shape and/or configuration as the first stationary vane subassembly 108.

Including a second stationary vane subassembly 108*b* may allow for the performance characteristics of the fan and motor assembly 102 to be configured based on the selected function of the appliance 100 in which the fan and motor assembly 102 is located within and/or the environment of the appliance 100. That is, the position of the first stationary vane subassembly 108 may be adjustable with respect to the position of the second stationary vane subassembly 108*b* between a first position and a second position to alter the performance characteristics of the fan and motor assembly 102.

Figure 7A:
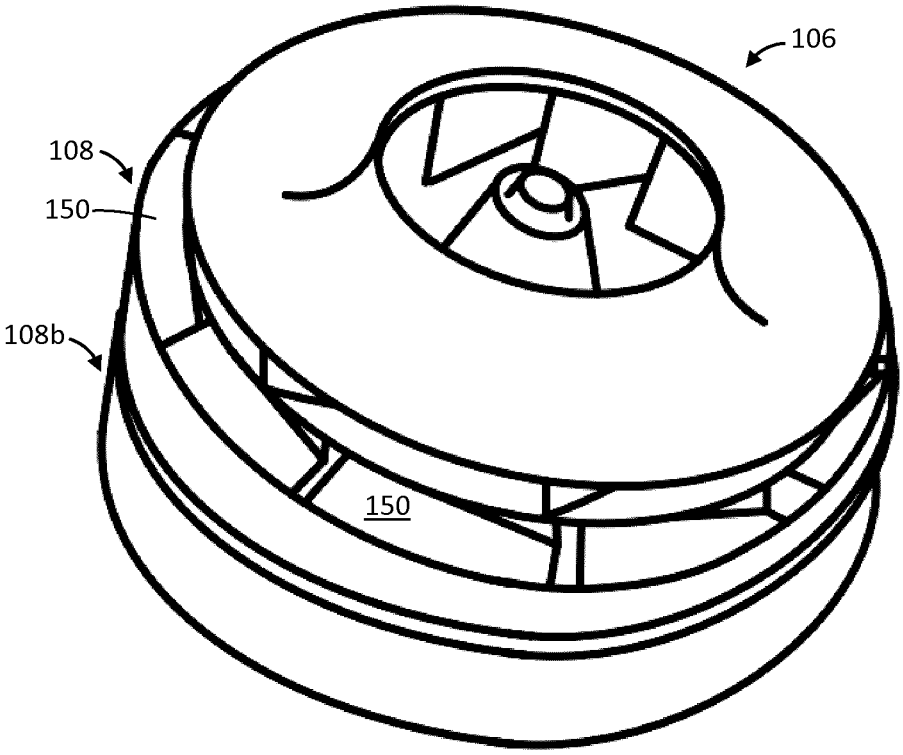
FIG. 7A is a perspective view of a motor and fan blade assembly having a rotating fan blade subassembly, a first stationary vane subassembly, and a second stationary vane subassembly.
Figure 7B:
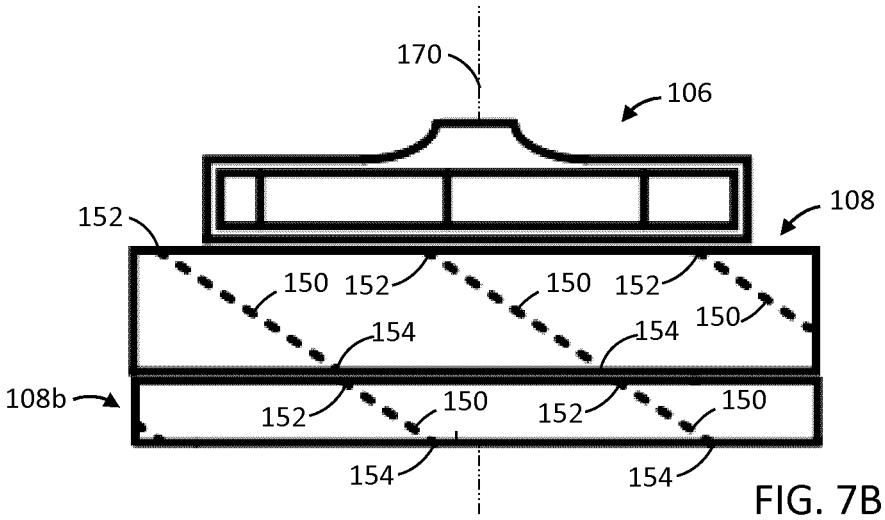
FIG. 7B is a side view of the rotating fan blade subassembly, the first stationary vane subassembly, and the second stationary vane subassembly of FIG. 7A, the first and second vane subassemblies are shown positioned relative to each other to promote enhanced suction.

For example, referring to FIG. 7B, the first stationary vane subassembly 108 and the second stationary vane subassembly 108*b* may be angularly positioned relative to each other so that the vanes 150 of the first stationary vane subassembly 108 are in line with the vanes 150 of the second stationary vane subassembly 108*b* (i.e., the trailing edge 154 of a vane 150 of the first stationary vane subassembly 108 may be aligned with a leading edge 152 of a vane 150 of the second stationary vane subassembly 108*b*). In the example illustrated, in this position, the vanes 150 of the first stationary vane subassembly 108 and the vanes 150 of the second stationary vane subassembly 108*b* essentially form continuous vanes 150 that have no overlap. Put another way, in the example illustrated, the set of vanes of the first stationary vane subassembly 108 are aligned with respect to the set of vanes of the second stationary vane subassembly 108*b* in a direction transverse to the axis of rotation 170 of the motor 110 such that bypass of the first stationary vane subassembly 108 and the second stationary vane subassembly 108*b* is inhibited. Accordingly, the vanes 150 of the first and second stationary vane subassemblies 108, 108*b* together may define a set of vanes 150 which increases the ability of the fan and motor assembly 102 to generate suction.

Figure 7C:
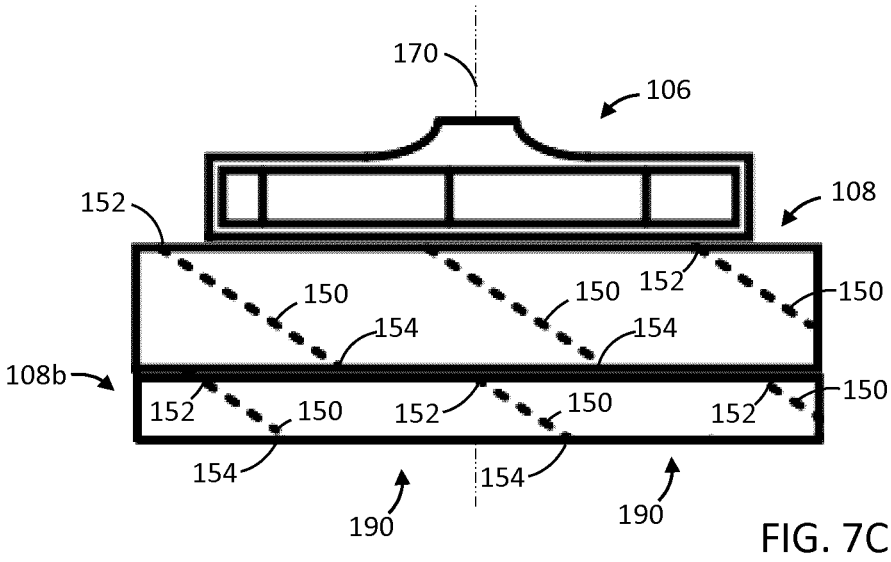
FIG. 7C is a side view of the rotating fan blade subassembly, the first stationary vane subassembly, and the second stationary vane subassembly of FIG. 7A, the first and second vane subassemblies are shown positioned relative to each other to promote enhanced air flow.

Alternatively, referring now to FIG. 7C, the first stationary vane subassembly 108 and the second stationary vane subassembly 108*b* may be angularly positioned relative to each other so that the vanes 150 of the first stationary vane subassembly 108 positively overlap with the vanes 150 of the second stationary vane subassembly 108.

In this position, as shown, the vanes 150 of the first and second stationary vane subassemblies 108, 108*b* may be positioned so that a bypass air gap 190 extends through each of the first and second stationary vane subassemblies 108, 108*b* along the axis of rotation 170 of the motor 110.

Accordingly, the vanes 150 of the first and second stationary vane subassemblies 108, 108*b* may together define a set of vanes 150 which increases the ability of the fan and motor assembly 102 to generate air flow.

The second stationary vane subassembly 108*b* may move with respect to the first stationary vane subassembly 108 by any means known in the art. For example, the second stationary vane subassembly 108*b* may rotate with respect to the first stationary vane subassembly 108. Any actuator known in the art may be used to rotate the second stationary vane subassembly 108*b* with respect to the first stationary vane subassembly 108. Further, any sensor known in the art, measuring any performance characteristic of the appliance 100 may be used to signal the actuator. Any actuator and any sensor described herein may be used. Alternatively, a user of the appliance 100 may manually reposition the second stationary vane subassembly 108*b* with respect to the first stationary vane subassembly 108 based on the desired performance characteristics of the appliance 100.

Figure 8A:
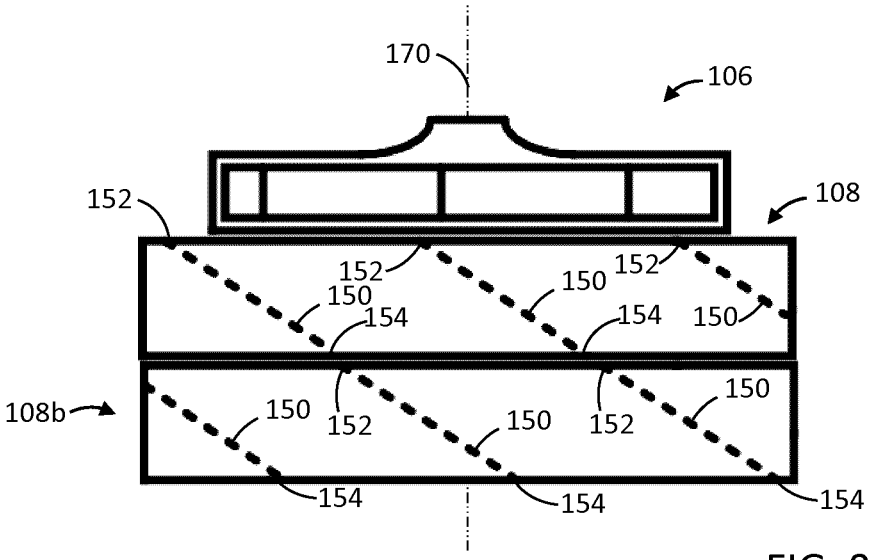
FIG. 8A is a side view of an alternative embodiment of a rotating fan blade subassembly, a first stationary vane subassembly, and a second stationary vane subassembly, the first and second vane subassemblies are shown positioned proximate to each other to promote enhanced suction.
Figure 8B:
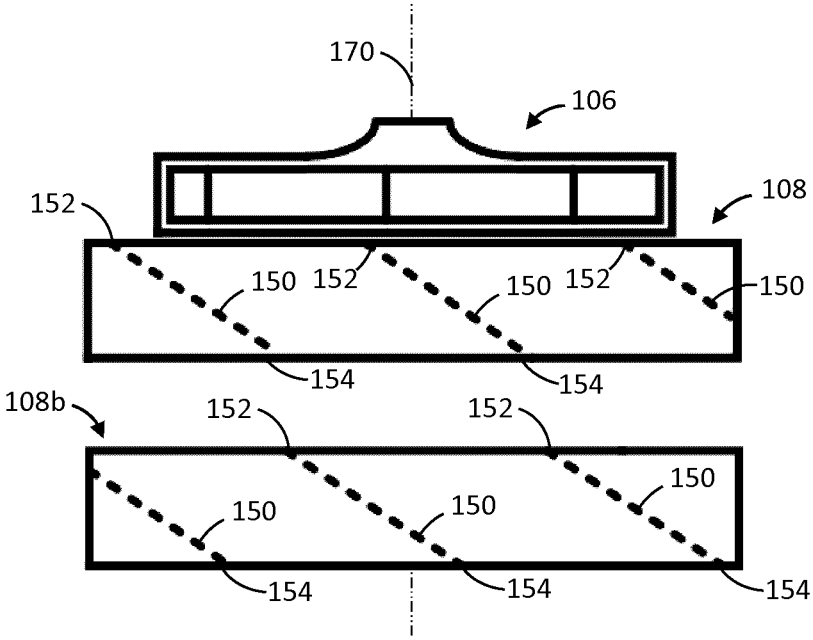
FIG. 8B is a side view of the rotating fan blade subassembly, the first stationary vane subassembly, and the second stationary vane subassembly of FIG. 8A, the first and second vane subassemblies are shown positioned spaced from each other to promote enhanced air flow.

Alternatively, or in addition, as exemplified in FIGS. 8A and 8B, the second stationary vane subassembly 108*b* may translate along the axis of rotation 170 of the rotating fan blade subassembly 106 with respect to the first stationary vane subassembly 108.

As shown, when the first and second stationary vane subassemblies 108, 108*b* are in contact, the vanes 150 of the first stationary vane subassembly 108 and the vanes 150 of the second stationary vane subassembly 108*b* may together define a set of combined vanes. As shown, a combined vane of the set of combined vanes may positively overlap with an adjacent combined vane. In some examples, a combined vane of the set of combined vanes may have no overlap with adjacent combined vanes (see, FIG. 7A). In this position, the first and second stationary vane subassemblies 108, 108*b* may promote suction.

Referring now to FIG. 8B, the second stationary vane subassembly 108*b* may translate away from the first stationary vane subassembly 108 along the axis of rotation 170 of the rotating fan blade subassembly 106. When the second stationary vane subassembly 108*b* is positioned away from the first stationary vane subassembly 108, air may more freely flow through the first and second stationary vane subassemblies 108, 108*b*. Therefore, in this position, the first and second stationary vane subassemblies 108, 108*b* may promote air flow through the fan and motor assembly 102.

It is to be understood that any number of stationary vane subassemblies 108 may be used within the fan and motor assembly 102.

Any actuator and any sensor described herein may be used to reconfigure the axial position of the first and second stationary vane subassemblies 108.

It will also be appreciated that the vanes of any stationary vane subassembly 108 may have any feature described herein, such as having a variable pitch or being moveable angularly with respect to each other to provide a bypass gap 190.

General Description of a Fan and Motor Assembly Having Dual Rotating Fan Blade Subassemblies In accordance with one aspect of this disclosure, which may be used by itself or in combination with any other aspect of this disclosure, the fan and motor assembly 102 may have more than one rotating fan blade subassembly 106.

A fan and motor assembly 102 may have more than one rotating fan blade subassembly 106 as a first rotating fan blade subassembly 106 may be designed for generating high suction and the second rotating fan blade subassembly 106*b* may be designed for generating high air flow through the fan and motor assembly 102. Accordingly, one rotating fan blade subassembly 106 may be selected, or may be configurable, to provide higher suction than a second rotating fan blade subassembly 106. Therefore, each rotating fan blade subassembly 106 that is provided in a motor and fan assembly 102 may be selected to provide, or may be reconfigurable to provide, higher air flow or higher suction. The air flow through the motor and fan assembly 102 may be adjusted to vary the amount of air provided to each of the rotating fan blade subassembly 106.

That is, for example, the first rotating fan blade subassembly 106 may have a higher number of rotatable blades 118 and/or smaller fan blade air channels 130 than the second rotating fan blade subassembly 106*b*, and may therefore, have different performance characteristics.

The fan and motor assembly 102 may be adjustable to vary an amount of air entering the fan and motor assembly 102 that is directed to each of the first and second rotating fan blade subassemblies 106, 106*b*. That is, for example, the configuration of the fan and motor assembly 102 may be adjustable to control the amount of air being provided to each of the first rotating fan blade subassembly 106 and the second rotating fan blade subassembly 106*b*. In some examples, in a first configuration, at least 10%, 20%, 30%, 40%, 50%, 60%, 70%, 80%, 90% or more of the air entering the fan and motor assembly 102 is directed to the first rotating fan blade subassembly 106, and in a second configuration, at least 10%, 20%, 30%, 40%, 50%, 60%, 70%, 80%, 90% or more of the air is directed to the second rotating fan blade subassembly 106*b*. In some examples, in a first configuration, essentially all or all of the air entering the fan and motor assembly 102 is directed to the first rotating fan blade subassembly 106, and in a second configuration, essentially all or all of the air is directed to the second rotating fan blade subassembly 106*b*.

The second rotating fan blade subassembly 106*b* may be of any shape and configuration. It will be appreciated that each of the rotating fan blade subassemblies 106, 106*b* may have any one or more of the aspects set out herein.

In order to selectively direct to air to one or both of the rotating fan blade subassemblies 106, 106*b*, the portion of the air flow path through the appliance that is upstream of the motor and fan assembly 102 may be selectively connected with one or both of the rotating fan blade subassemblies 106, 106*b*. For example, the position of one or more outlets of the vortex finder 142 with respect to an inlet of each of the rotating fan blade subassemblies 106, 106*b* may be adjustable. Accordingly, the vortex finder 142 may be operable to direct air flow to one of the first or the second rotating fan blade subassemblies 106, 106*b*. Further, the vortex finder 142 may be operable to direct air flow to both of the first and second rotating fan blade subassemblies 106, 106*b*.

Figure 9A:
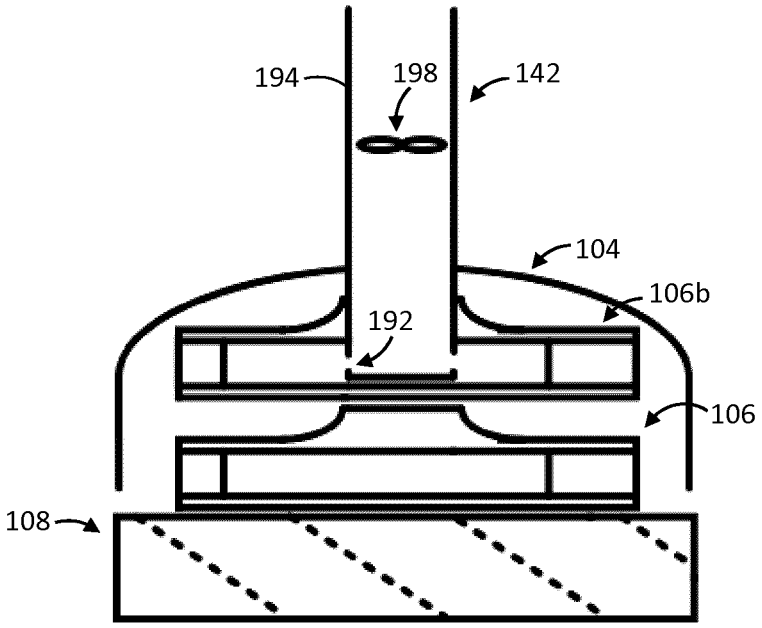
FIG. 9A is a side view of a further alternative embodiment of a fan and motor assembly (without the motor) and a vortex finder, the fan and motor assembly having a first rotating fan blade subassembly and a second rotating fan blade subassembly, wherein the vortex finder positioned to direct air flow to the first rotating fan blade subassembly.
Figure 9B:
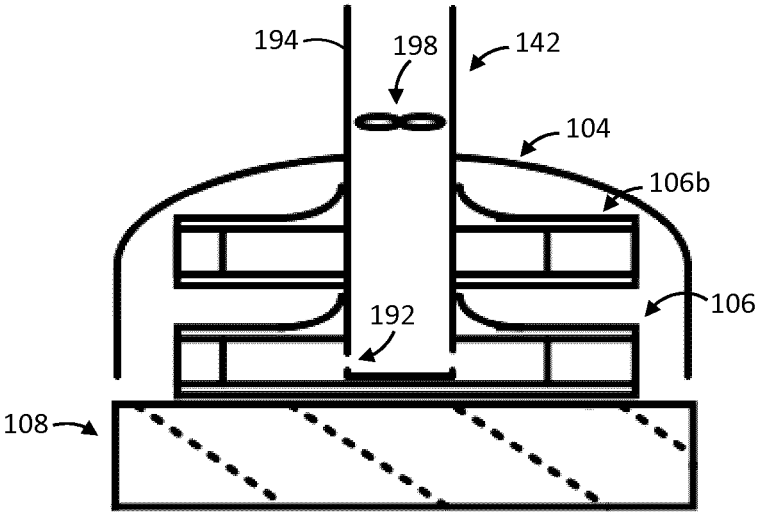
FIG. 9B is a side view of the fan and motor assembly and the vortex finder of FIG. 9A, wherein the vortex finder positioned to direct air flow to the second rotating fan blade subassembly.

For example, referring to FIGS. 9A and 9B, the vortex finder 142 may have a slot outlet 192 in a sidewall 194 of the vortex finder 142 near its distal end 180, through which air may exit the vortex finder 142 and flow into the first rotating fan blade subassemblies 106 (see FIG. 9A) and the second rotating fan blade subassemblies 106*b* (see FIG. 9B), based on the position of the vortex finder 142.

Figure 9C:
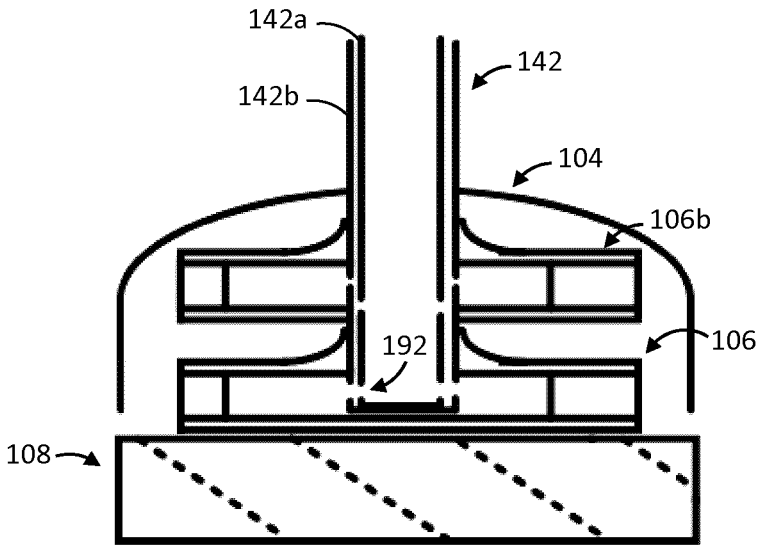
FIG. 9C is a side view of a further alternative embodiment of a fan and motor assembly (without the motor), a first vortex finder, and a second vortex finer, the fan and motor assembly having a first rotating fan blade subassembly and a second rotating fan blade subassembly, wherein the first and second vortex finders are positioned to direct air flow to the first rotating fan blade subassembly.
Figure 9D:
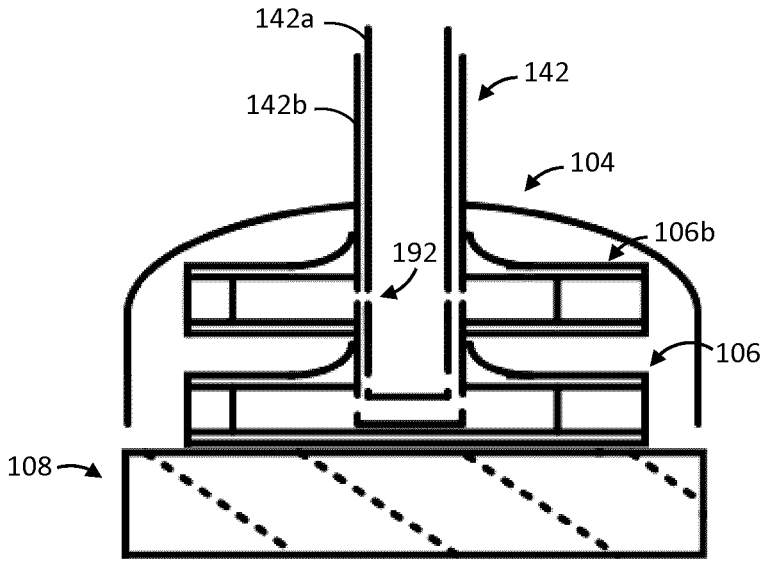
FIG. 9D is a side view of the fan and motor assembly, the first vortex finder, and the second vortex finder of FIG. 9C, wherein the first and second vortex finders are positioned to direct air flow to the second rotating fan blade subassembly.

Alternatively, referring now to FIGS. 9C and 9D, the fan and motor assembly 102 may include a first (i.e., inner) vortex finder 142*a* and a second (i.e., outer) vortex finder 142*b*. The inner vortex finder 142*a* may move with respect to the outer vortex finder 142*b* to direct air to one of the first or the second rotating fan blade subassemblies 106, 106*b*. For example, as shown, when in a first position (see FIG. 9C) the first and second vortex finders 142*a*, 142*b* cooperate to direct air to the first rotating fan blade subassembly 106. In this configuration the outlets 192 that are closer to the distal end 180 of the inner and outer vortex finders 142*a* and 142*b* are aligned such that air exits the vortex finder 142 through outlets 192 that are provided, and enters the flow channels of the first rotating fan blade subassembly 106. At the same time, the axially inner outlets 192 of the inner and outer vortex finders 142*a* and 142*b* are offset such that air is inhibited from exiting through the axially inner outlets 192 into the flow channels of the second rotating fan blade assembly 106*b*. In a second position (see FIG. 9D), the first and second vortex finders 142*a*, 142*b* cooperate to direct air to the second rotating fan blade subassembly 106*b*. In this configuration each of the axially inner outlets 192 of the inner and outer vortex finders 142*a* and 142*b* are aligned such that air exits the vortex finder 142 through the axially inner outlets 192 and enters the flow channels of the second rotating fan blade subassembly 106*b*. At the same time, the outlets 192 at the distal end 180 of the inner and outer vortex finders 142*a* and 142*b* are offset such that air is inhibited from exiting through the outlets 192 at the distal end 180 of the inner and outer vortex finders 142*a* and 142*b* into the flow channels of the first rotating fan blade assembly 106.

As shown, when using a first and second vortex finder 142*a*, 142*b* to selectively direct air to the first or the second rotating fan blade subassemblies 106, 106*b*, the magnitude of displacement required for the vortex finder 142 to move is less than that when using a single vortex finder 142. Accordingly, in compact appliances 100, first and second vortex finder 142*a*, 142*b* may be used to selectively direct air to one of the first and second rotating fan blade subassemblies 106, 106*b*.

It is to be understood that the fan and motor assembly 102 may include any number of rotating fan blade subassemblies 106 and any number of vortex finders 142 to selectively direct air to the any number of rotating fan blade subassemblies 106.

Optionally, in accordance with an aspect which may be used by itself or in combination with any one or more aspects set out herein, as shown, a fan 198 may be positioned within the vortex finder 142 to promote airflow through the fan and motor assembly 102.

The vortex finder(s) 142 may be axially moveable as discussed previously herein. Optionally, a user of the appliance 100 may manually move the vortex finder(s) 142. In some examples, the vortex finder(s) 142 may automatically be moveable to direct air through the first rotating fan blade subassembly 106 or the second rotating fan blade subassembly 106*b* based on the rotational speed of the rotating fan blade subassemblies 106, 106*b*. That is, the first and second rotating fan blade subassemblies 106, 106*b* may both be connected to the motor 110 and therefore be rotated at the same speed, when in use. At low RPM the vortex finder(s) 142 may direct air to, for example, the first rotating fan blade subassembly 106 which may be designed for high suction whereas at high RPM, the vortex finder(s) 142 may direct air to, for example, the second rotating fan blade subassembly 106*b* which may be designed for high air flow.

It will be appreciated that the vortex finder(s) 142 may direct air to both the first and second rotating fan blade subassemblies 106, 106*b* simultaneously.

It will also be appreciated that the air may be directed to the second rotating fan blade subassembly 106*b* and then subsequently pass through the first rotating fan blade subassembly 106. For example, in a first configuration, at least 10%, 20%, 30%, 40%, 50%, 60%, 70%, 80%, 90% or more of the air entering the fan and motor assembly 102 is directed to the second rotating fan blade subassembly 106*b* and then subsequently at least 10%, 20%, 30%, 40%, 50%, 60%, 70%, 80%, 90% or more of the air is then directed through the first rotating fan blade subassembly 106. As a second example, in a first configuration, essentially all or all of the air entering the fan and motor assembly 102 is directed to the second rotating fan blade subassembly 106*b* and then subsequently through the first rotating fan blade subassembly 106.

In yet another example, in a first configuration, the air entering the fan and motor assembly 102 flows in series through the second rotating fan blade subassembly 106*b* and then the first rotating fan blade subassembly 106 and, in a second configuration, the air entering the fan and motor assembly 102 flows through only one of the first rotating fan blade subassembly 106 and the second rotating fan blade subassembly 106*b*.

In yet another example, the fan and motor assembly 102 may have a third configuration in which the first rotating fan blade subassembly 106 provides a third level of air flow and a third level of suction. The third level of suction may be higher than the first level of suction and the third level of airflow may be lower than the first level of air flow. The position of the vortex finder with respect to the first rotating fan blade subassembly 106 may be adjustable so that first rotating fan blade subassembly 106 may provide a first and third level of air flow and suction.

In a particular example, two rotating fan blade subassemblies may be provided. In this example, the first (upstream) rotating fan blade subassembly that the air first enters may be configured to provide higher suction and lower air flow than a second (downstream) rotating fan blade subassembly. The second (downstream) rotating fan blade subassembly may be configured to provide lower suction and higher air flow than the first (upstream) rotating fan blade subassembly. If all the air travels sequentially through both of the rotating fan blade subassemblies, then the two rotating fan blade subassemblies may provide a higher level of suction than either rotating fan blade subassembly by itself. If the air travels in parallel through both of the rotating fan blade subassemblies, then the two rotating fan blade subassemblies may provide a higher level of air flow than either rotating fan blade subassembly by itself. In such a case, the air may self-balance the amount which travels through each rotating fan blade subassembly.

Optionally, if two fan blades assemblies are provided, then the first and second rotating fan blade subassemblies 106, 106*b* may automatically engage and disengage from the rotating drive shaft 114 of the motor 110 at different RPMs so that the fan and motor assembly 102 has the desired performance characteristics when the rotating fan blade subassemblies 106, 106*b* are rotating within the appropriate RPM range. For example, a first inertial locking member may non-rotatably mount a first rotating fan blade subassembly 106 to the motor shaft in a first range of RPM (e.g., a low range of RPM) and a second inertial locking member may non-rotatably mount a second rotating fan blade subassembly 106 to the motor shaft in a second range of RPM (e.g., a higher range of RPM). Alternately, a single inertial locking member maybe used. Accordingly, the inertial locking member may non-rotatably mount a first rotating fan blade subassembly 106 to the motor shaft in a first range of RPM and then disengage the first rotating fan blade subassembly 106 and non-rotatably mount a second rotating fan blade subassembly 106 to the motor shaft at a second range of RPM. It will be appreciated that, at an intermediate range of RPM, both the first and second rotating fan blade subassemblies may be non-rotatably mounted to the motor shaft. It will be appreciated that this aspect may be used if no vortex finder is provided or if a non-moveable (fixed or static) vortex finder is provided.

In the example illustrated, regardless of whether air passes through the first rotating fan blade subassembly 106 or the second rotating fan blade subassembly 106*b*, after passing through the first or the second rotating fan blade subassemblies 106, 106*b*, the air optionally passes through the same stationary vane subassembly 108. Alternatively, in some embodiments of the fan and motor assembly 102, each rotating fan blade subassembly 106, 106*b* may direct air to a different stationary vane subassembly 108. That is, there may be a first stationary vane subassembly associated with the first rotating fan blade subassembly 106 and there may be a second stationary vane subassembly associated with the second rotating fan blade subassembly 106*b*. Accordingly, in some examples, air may pass through the first rotating fan blade subassembly 106, through a first stationary vane subassembly associated with the first rotating fan blade subassembly 106, through the second rotating fan blade subassembly 106*b*, and then through a second stationary vane subassembly associated with the second rotating fan blade subassembly 106. Alternately, in accordance with this aspect, a stationary vane subassembly may not be used.

General Description of a Rotating Dome

In accordance with one aspect of this disclosure, which may be used by itself or in combination with any other aspect of this disclosure, the fan and motor assembly 102 includes a rotating dome 200. The rotating dome 200 may be of any shape and configuration, and may be connected to, or an integral component of, the rotating fan blade subassembly 106.

Figure 10A:
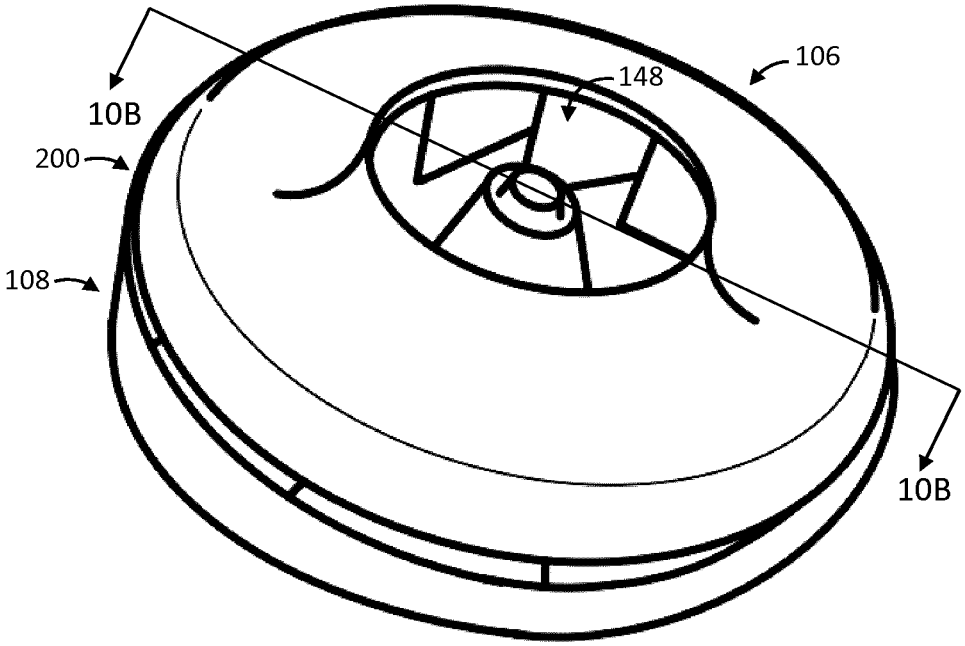
FIG. 10A is a perspective view of a further alternative embodiment of a rotating fan blade subassembly and a stationary vane subassembly.
Figure 10B:
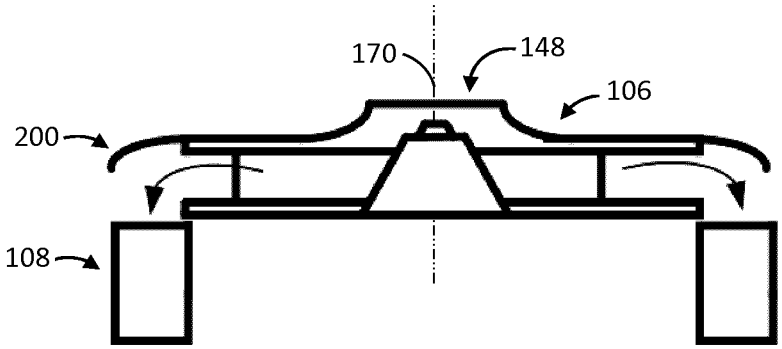
FIG. 10B is a cross-sectional view of the rotating fan blade subassembly and the stationary vane subassembly of FIG., taken along line 10B—10B.
Figure 10C:
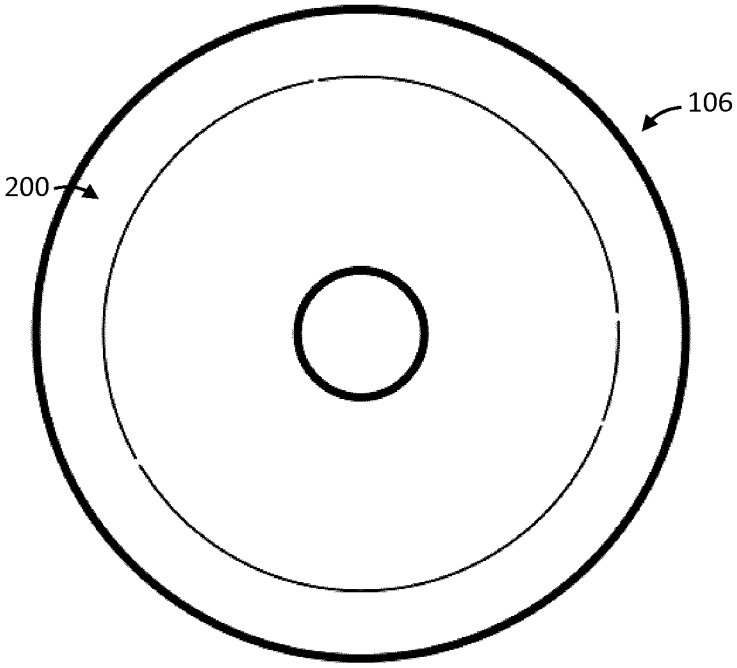
FIG. 10C is a top view of the rotating fan blade subassembly and the stationary vane subassembly of FIG. 10A.

As exemplified in FIGS. 10A-10C, the rotating dome 200 may direct air, which exits the rotating fan blade subassembly 106 in a direction substantially perpendicular to the rotational axis 170 of the rotating fan blade subassembly 106, downwardly in a direction substantially parallel to the rotational axis 170 of the rotating fan blade subassembly 106.

That is, the rotating dome 200 may be used to redirect the air as opposed to, or in addition to, the shield 104, as described previously. In some examples, the rotating dome 200 and the shield 104 are separate components of the fan and motor assembly 102. That is, the rotating dome 200 may be housed within the shield 104. In other examples, the rotating dome 200 and the shield 104 are the same component (i.e., the shield 104 may be configured to rotate).

A rotating dome 200 may be used to redirect the air as opposed to a stationary shield 104, as the rotating dome 200 may reduce the amount of noise generated by the air when being redirected.

General Description of Air Flow Through the Rotating Fan Blade Subassembly

In accordance with one aspect of this disclosure, which may be used by itself or in combination with any other aspect of this disclosure, air may flow through the rotating fan blade subassembly 106 such that the direction of the air as it enters the rotating fan blade subassembly 106 is substantially parallel to the direction of the air as it exits the rotating fan blade subassembly 106.

Figure 11A:
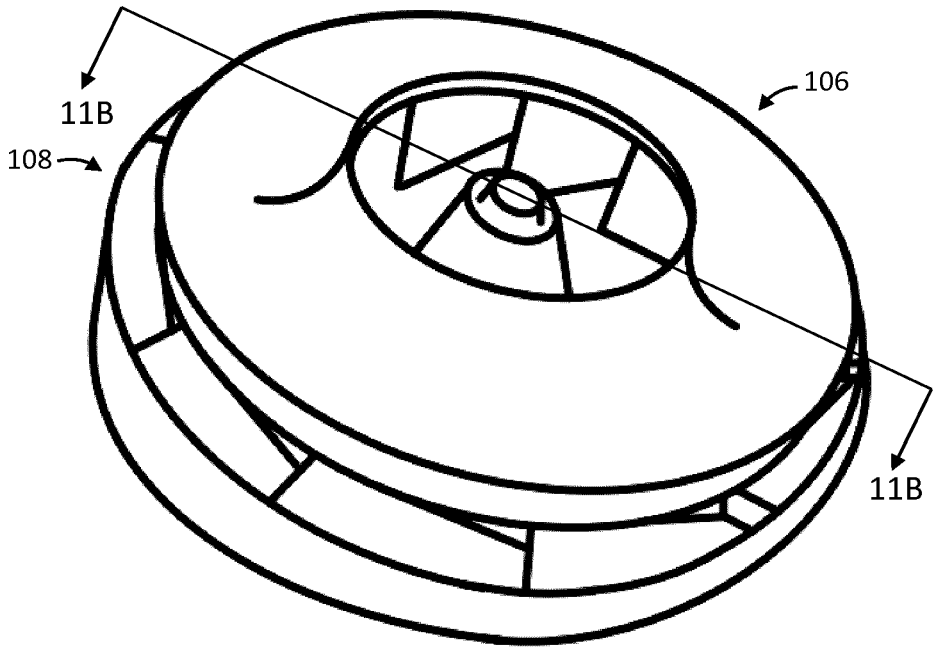
FIG. 11A is a perspective view of a further alternative embodiment of a rotating fan blade subassembly and a stationary vane subassembly.

As described previously, air may be introduced to the rotating fan blade subassembly 106 via a conduit or a vortex finder 142 through an inlet 138 of the rotating fan blade subassembly 106. With respect to FIG. 11A, the air may enter the rotating fan blade subassembly 106 substantially parallel to the rotational axis 170 of the rotating fan blade subassembly 106.

Figure 11B:
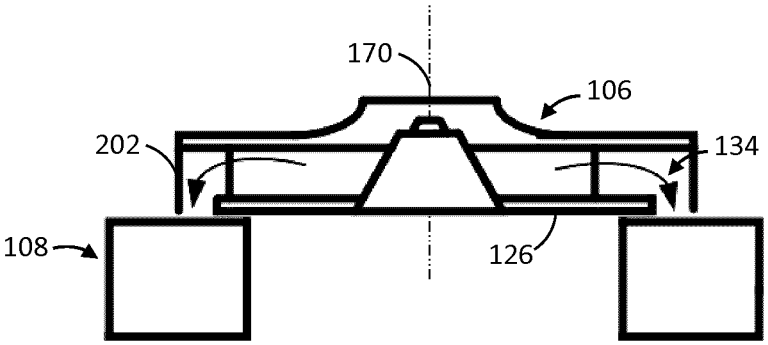
FIG. 11B is a cross-sectional view of the rotating fan blade subassembly and the stationary vane subassembly of FIG. 11A, taken along line 11B—11B.
Figure 11C:
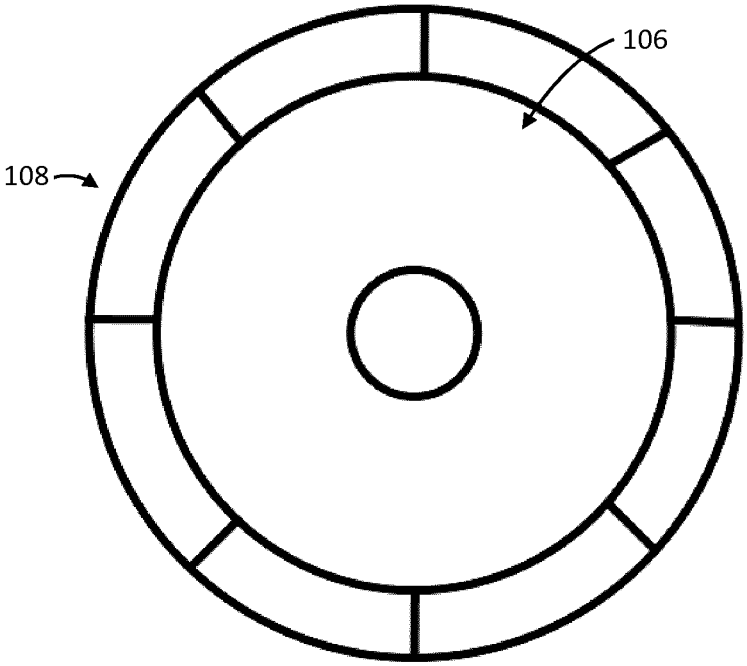
FIG. 11C is a top view of the rotating fan blade subassembly and the stationary vane subassembly of FIG. 11A.

Referring now to FIG. 11B, the fan blade air channel outlet 134 may be located in the lower wall 126 of the rotating fan blade subassembly 106 (as opposed to being located intermediate the upper wall 124 and the lower wall 126, as shown in FIG. 1B).

Accordingly, as shown, the direction of the air as it exits the rotating fan blade subassembly 106 may be substantially parallel to the rotational axis 170 of the rotating fan blade subassembly 106.

In this embodiment, the stationary vane subassembly 108 may be located, at least partially, radially inward of a radial distal end wall 202 of rotating fan blade subassembly 106. Positioning the stationary vane subassembly 108 radially inward of the radial distal end wall 202 may allow for the air to readily flow from the rotating fan blade subassembly 106 to the stationary vane subassembly 108.

In some examples, the radial distal end wall 202 of the rotating fan blade subassembly 106 may be made of a sound absorbent material.

General Description of a Variable Gap Between the Fan Blade and the Shield

In accordance with one aspect of this disclosure, which may be used by itself or in combination with any other aspect of this disclosure, the performance characteristics of the fan and motor assembly 102 may be configurable by adjusting the gap between an upstream face of the rotating fan blade subassembly 106 and the shield 104 of the fan and motor assembly 102. Increasing the gap may increase the air flow produced by the fan and motor assembly 102 whereas decreasing the gap may increase the suction produced by the fan and motor assembly 102.

The gap may be adjustable by manually moving the rotating fan blade subassembly 106 with respect to the shield 104. Alternately, the rotating fan blade subassembly 106 may be moved by an electronically actuated member (e.g., a solenoid). As exemplified in FIGS. 12A and 12B, a handle 204 is moveably (e.g., pivotally) mounted to a main body 206 of the appliance 100 (in this example, a hair dryer). Pivoting the handle 204 adjusts the gap between the upstream face of rotating fan blade subassembly 106 and the shield 104. Accordingly, a mechanical linkage extending between the handle 204 and the shield 104 and/or rotating fan blade subassembly 106 may be provided. As the handle 204 is pivoted, e.g., forwardly from, for example, the high suction mode position of FIG. 12A to the, for example, high air flow mode position of FIG. 12B, the gap between the upstream face of the rotating fan blade subassembly 106 and the shield 104 is increased thereby adjusting fan and motor assembly 102 to produce higher air flow and lower suction. Conversely, as the handle 204 is pivoted, e.g., rearwardly from the high air flow mode of FIG. 12B to the high suction mode position of FIG. 12A, the gap between the upstream face of the rotating fan blade subassembly 106 and the shield 104 is decreased thereby adjusting fan and motor assembly 102 to produce higher suction and lower air flow.

Figure 12A:
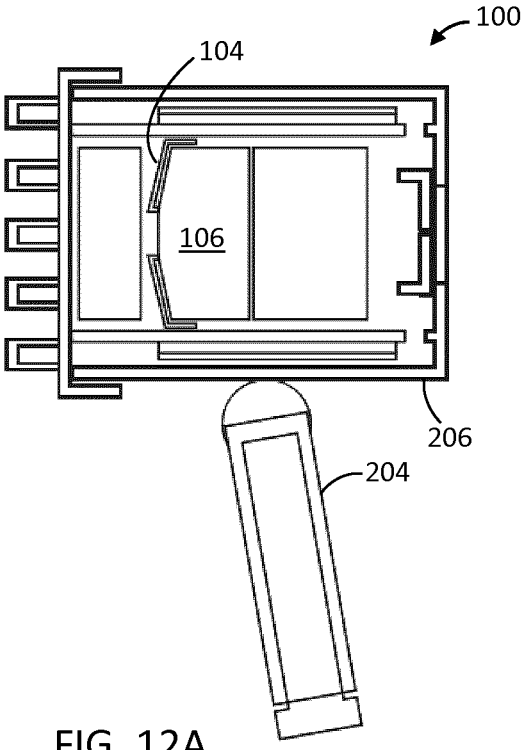
FIG. 12A is a cross-sectional view of a hair dryer having an embodiment of a fan and motor assembly installed therein, wherein the fan and motor assembly is configured to promote enhanced suction; and, FIG. 12B is a cross-sectional view of the hair dryer of FIG. 12A, wherein the fan and motor assembly is configured to promote enhanced air flow.
Figure 12B:
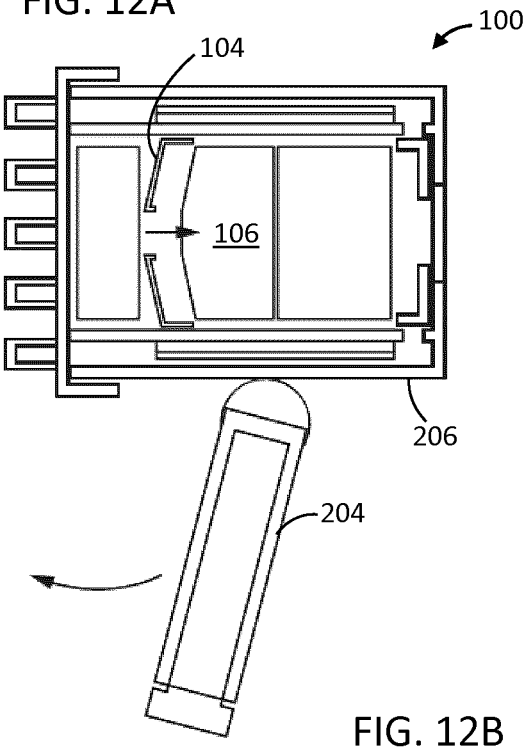

In the embodiment of FIGS. 12A and 12B, the redirecting member may be concurrently or separately moved between to adjust the air flow path from a straight through air flow path which may be used for suction drying (FIG. 12A) to one wherein the air is redirected to exit the front of the hair dryer for, e.g., blow drying (FIG. 12B).

Accordingly, when a user desires to change drying mode from the first mode to the second mode, the user may rotate the handle forwardly to produce higher air flow for blow drying.

It will be appreciated that any actuator and any sensor described herein may be used.

General Description of Specific Configurations of the Fan and Motor Assembly

In accordance with one aspect of this disclosure, which may be used by itself or in combination with any other aspect of this disclosure, the fan and motor assembly 102 may have a specific configuration. It will be appreciated that a reconfigurable motor and fan blade assembly may be reconfigured to any specific configuration set out herein or between any two specific configurations set out herein.

For example, referring to FIG. 1F, the vortex finder may have an inlet diameter 210, so that an inlet area of the vortex finder is between 0.785 to 0.950 square inches for every 50 cfm of open flow when there is no static pressure at the inlet (i.e., the inlet 138 to the rotating fan blade subassembly 106) or outlet (i.e., the stationary vane air channel exit) of the fan and motor assembly 102.

Alternately or in addition, still referring to FIG. 1F, the vortex finder may be placed between 0.01 to 0.05 inches into the rotatable blades 118 of the rotating fan blade subassembly 106, see 212 in FIG. 1F. That is, an end wall 214 of the vortex finder 142 may be positioned 0.01 to 0.05 inches, in a direction parallel to the axis of rotation 170 of the rotating fan blade subassembly 106, from the flange 140 extending about the inlet 138 to the fan blade air channels 130.

Alternately or in addition, referring now to FIG. 1B, the rotating fan blade subassembly 106 may have an air channel inlet area between 0.875 and 1.140 square inches for every 50 cfm of open flow when there is no static pressure at the inlet or outlet of the motor. The air channel inlet area of the rotating fan blade subassembly 106 is defined by the space radially inward of the inlets 132 to the fan blade air channels 130. Accordingly, the area of the inlet 138 to the rotating fan blade subassembly 106 may be less than the area of the inlet 132 to the fan blade air channels 130 due to the flange 140.

Alternately or in addition, still referring to FIG. 1B, the area, measured by taking the internal height of the rotatable blades 118 at the inlet 132 to the fan blade air channels 130 multiplied by the circumference of the circle forming the air channel inlet area, may be between 1.31 to 1.93 square inches for every 50 cfm of open flow when there is no static pressure at the inlet or outlet of the fan and motor assembly 102.

Alternately or in addition, still referring to FIG. 1B, the height of the trailing edge 122 of rotatable blades 118 at the fan blade air channel outlet 134 multiplied by the circumference of a circle defined by the trailing edges 122 of the rotatable blades 118 at the fan blade air outlets 134 may be between 1.54 to 1.85 square inches for every 50 cfm of airflow.

Alternately or in addition, referring now to FIG. 1C, the stationary vane subassembly 108 may have a projected annular area in a plane perpendicular to the rotational axis of the rotating fan blade subassembly 106 of 1.54 to 1.85 square inches for every 50 cfm of airflow. The projected annular area can be determined by first calculating the area between the inner hub 162 and the outer hub 164 of the stationary vane subassembly 108, and then subtracting the area of the plurality of vanes (in the example illustrated, because each vane 150 in the plurality of vanes is identical, the area of the plurality of vanes can be determined by multiplying the number of vanes 150 by the thickness 216 of each vane 150 and by the distance between the inner hub 162 and the outer hub 164).

Alternately or in addition, referring to FIG. 1E, the distance between the fan blade air outlets 134 of the fan blade air channels 130 and an inner wall 218 of the shield 104 or the interior wall 220 of any vane 150 may be not less than 0.190 inches, optionally 0.265 inches and most optionally 0.375 inches for every 50 cfm of airflow.

Alternately or in addition, the ratio fan inlet area to fan outlet area may be 0.75:1 to 1.5:1 and/or the ratio fan outlet area to vane area may be 0.5:1 to 0.75:1.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, an appliance may have one or more of the following: a rotating fan blade subassembly wherein the fan blades are adjustable by one or more of varying the pitch of the blades or the angular distance between the blades; a plurality of rotating fan blade subassemblies wherein one or more of the rotating fan blade subassemblies is in a fixed configuration; a plurality of rotating fan blade subassemblies wherein one or more of the rotating fan blade subassemblies is reconfigurable; a plurality of rotating fan blade subassemblies wherein air is directed selectively though one or more of the plurality of rotating fan blade subassemblies; a plurality of rotating fan blade subassemblies wherein one or more of the rotating fan blade subassemblies is reconfigurable; a plurality of rotating fan blade subassemblies wherein air is directed in series through the plurality of rotating fan blade subassemblies; a plurality of rotating fan blade subassemblies wherein air is directed in parallel through the plurality of rotating fan blade subassemblies; any of the rotating fan blade subassemblies in combination with one or more stationary vane subassembly wherein the stationary vane subassembly may be of a fixed or variable configuration and/or wherein the axial and/or angular position of the stationary vane subassembly is moveable with respect to the position of the rotating fan blade subassembly; a vortex finder wherein the position of the outlet of the vortex finder to the inlet of the rotating fan blade assembly is adjustable; a vortex finder wherein the length of the cross-sectional flow area is adjustable; a seal between the shield and a rotating fan subassembly; a rotating dome and the spacing between the shield (dome) and the rotating fan blade subassembly is variable.

Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

What is claimed is:

1. A household appliance having an air flow path extending from an air inlet to an air outlet with a fan and motor assembly in the air flow path, the fan and motor assembly comprising a motor drivingly connected to a first rotating fan blade subassembly and a shield, the first rotating fan blade subassembly comprising a plurality of rotatable blades, a vortex finder and a plurality of fan blade air channels, the motor has an axis of rotation, the vortex finder having an outlet that communicates with an inlet of the first rotating fan blade subassembly, and the position of the vortex finder to the inlet is adjustable between a first position in which the fan and motor assembly is in a first configuration and the first rotating fan blade subassembly provides a first level of air flow and a first level of suction and a second position in which the fan and motor assembly is in a second configuration in which the first rotating fan blade subassembly provides a second level of air flow and a second level of suction wherein the first level of air flow is higher than the second level of air flow and the second level of suction is higher than the first level of suction.

2. The household appliance of claim 1 wherein, in the second position, the vortex finder blocks a portion of an entrance to the plurality of fan blade air channels.

3. The household appliance of claim 2 wherein, in the first position, the vortex finder is axially spaced from the entrance to the plurality of fan blade air channels.

4. The household appliance of claim 1 wherein the fan and motor assembly further comprises a seal positioned between the first rotating fan blade subassembly and the shield whereby air entering the fan and motor assembly is inhibited from bypassing the plurality of fan blade air channels.

5. The household appliance of claim 1 wherein the fan and motor assembly further comprises a first stationary vane subassembly, the first stationary vane subassembly comprising a plurality of vanes and a plurality of stationary vane air channels, each of the vanes has a leading edge and a trailing edge in a direction of rotation of the first rotating fan blade subassembly, wherein the alignment of the plurality of vanes is adjustable between a first position and a second position, wherein in the second position the leading edge of one vane is angularly spaced apart from a trailing edge of an adjacent vane in a direction transverse to the axis of rotation of the motor, whereby a plurality of bypass air gaps are provided within the stationary vane subassembly that extend through the stationary vane air channels along the axis of rotation of the motor.

6. The household appliance of claim 5 wherein, in the first position, the leading edge of each vane is in line with the trailing edge of the adjacent vane along the axis of rotation of the motor.

7. The household appliance of claim 1 wherein the fan and motor assembly further comprises a first stationary vane subassembly, the first stationary vane subassembly comprising a first set of vanes, a second set of vanes and a plurality of stationary vane air channels, the stationary vane air channels have a width in the direction of rotation of the motor, wherein the position of the first set of vanes with respect to the second set of vanes is adjustable whereby the width of the stationary vane air channels is adjustable.

8. The household appliance of claim 7 wherein the position of the first set of vanes with respect to the second set of vanes is adjustable between a first position and a second position, in the first position the first set of vanes is adjacent the second set of vanes and a first number of stationary vane air channels is provided and, in the second position, the first set of vanes is spaced from the second set of vanes and a second number of stationary vane air channels is provided and the second number of stationary vane air channels is greater than the first number of stationary vane air channels.

9. The household appliance of claim 1 wherein the fan and motor assembly further comprises a first stationary vane subassembly having a first set of vanes and a first plurality of stationary vane air channels and a second stationary vane subassembly having a second set of vanes and a second plurality of stationary vane air channels, wherein the position of the first set of vanes is adjustable with respect to the position of the second set of vanes.

10. The household appliance of claim 9 wherein the position of the first set of vanes is adjustable with respect to the position of the second set of vanes between a first position and a second position, wherein in the second position the first set of vanes is angularly spaced from the second set of vanes in a direction transverse to the axis of rotation of the motor, whereby a plurality of bypass air gaps are provided within the first and second stationary vane subassemblies that extend through the stationary vane air channels along the axis of rotation of the motor.

11. The household appliance of claim 10 wherein, in the first position, the first set of vanes is aligned with respect to the second set of vanes in a direction transverse to the axis of rotation of the motor whereby bypass of the first stationary vane subassembly and the second stationary vane subassembly is inhibited.

12. The household appliance of claim 1 wherein the fan and motor assembly further comprises a rotating dome that overlies the first rotating fan blade subassembly.

13. The household appliance of claim 1 wherein the first rotating fan blade subassembly has a first end providing an inlet to the first rotating fan blade subassembly and an axially spaced apart second end and the plurality of fan blade air channels have channel outlets that are provided in an end wall of the second end.

14. The household appliance of claim 1 wherein the first rotating fan blade subassembly has an end spaced from and facing the shield and a gap between the end and the shield is variable.

15. The household appliance of claim 1 wherein a pitch of the plurality of rotatable blades is adjustable.

16. The household appliance of claim 1 wherein a diameter of the vortex finder is adjustable.

17. The household appliance of claim 1 wherein the fan and motor assembly further comprises a first stationary vane subassembly having a first set of vanes and a first plurality of stationary vane air channels and a pitch of the first set of vanes is adjustable.

18. The household appliance of claim 1 wherein the household appliance is a vacuum cleaner, an extractor or a hair dryer.

* * * * *